US012662824B2

(12) United States Patent
Boo et al.

(10) Patent No.: US 12,662,824 B2
(45) Date of Patent: Jun. 23, 2026

(54) SET OF PANELS COMPRISING A LOCKING DEVICE

(71) Applicant: Välinge Innovation AB, Viken (SE)

(72) Inventors: Fredrik Boo, Kågeröd (SE); Anders Nilsson, Helsingborg (SE)

(73) Assignee: VÄLINGE INNOVATION AB, Viken (SE)

( * ) Notice: Subject to any disclaimer, the term of this patent is extended or adjusted under 35 U.S.C. 154(b) by 211 days.

(21) Appl. No.: 18/370,443

(22) Filed: Sep. 20, 2023

(65) Prior Publication Data

US 2024/0093508 A1 Mar. 21, 2024

(30) Foreign Application Priority Data

Sep. 21, 2022 (SE) ..... 2251094-5

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0146* (2013.01); *E04F 2201/023* (2013.01); *E04F 2201/042* (2013.01); *E04F 2201/043* (2013.01); *E04F 2201/049* (2013.01)

(58) Field of Classification Search
CPC ..... E04F 15/00; E04F 15/02038; E04F 15/02066; E04F 15/02072; E04F 13/0894; E04F 2201/0146; E04F 2201/0161; E04F 2201/023; E04F 2201/042; E04F 2201/043; E04F 2201/044; E04F 2201/049
See application file for complete search history.

(56) References Cited

U.S. PATENT DOCUMENTS 7,721,503 B2 * 5/2010 Pervan ..... E04F 15/02 52/177
11,326,353 B2 * 5/2022 Nilsson ..... E04F 15/02038
11,987,992 B2 * 5/2024 Boo ..... E04F 13/0894
(Continued)

FOREIGN PATENT DOCUMENTS

DE 102015106035 A1 2/2016
EP 1929103 A1 6/2008
(Continued)

OTHER PUBLICATIONS

U.S. Appl. No. 18/635,607, filed Apr. 15, 2024, Fredrik Boo.
(Continued)

*Primary Examiner* — Chi Q Nguyen
(74) *Attorney, Agent, or Firm* — Boone IP Law

(57) ABSTRACT

A set of panels includes a locking device for locking a first edge portion of a first panel to a second edge portion of a second panel. The locking device includes a horizontal locking device and a vertical locking device. The vertical locking device includes a separate tongue arranged in an insertion groove of the first edge portion and a tongue groove provided in the second edge portion. In a vertically locked state of the first and second edge portions, an abutment member provided at a longitudinal end portion of the separate tongue cooperates with a stop surface of the second edge portion, and a locking portion of the separate tongue cooperates with the tongue groove.

20 Claims, 14 Drawing Sheets

(56) References Cited

U.S. PATENT DOCUMENTS

| | | | | |
|---|---|---|---|---|
| 12,188,239 | B2 * | 1/2025 | Nilsson | E04F 15/02033 |
| 12,297,648 | B2 * | 5/2025 | Larsson | E04F 15/02038 |
| 2004/0020152 | A1 | 2/2004 | Steven | |
| 2006/0101769 | A1 * | 5/2006 | Pervan | E04F 15/02 52/591.1 |
| 2008/0010937 | A1 * | 1/2008 | Pervan | E04F 15/02 52/588.1 |
| 2009/0193748 | A1 * | 8/2009 | Boo | B27F 1/02 408/1 R |
| 2012/0042598 | A1 | 2/2012 | Vermeulen et al. | |
| 2013/0042565 | A1 * | 2/2013 | Pervan | E04F 15/02038 52/588.1 |
| 2016/0153200 | A1 * | 6/2016 | Pervan | E04F 15/102 52/582.2 |
| 2018/0313094 | A1 | 11/2018 | Pervan | |
| 2021/0087827 | A1 * | 3/2021 | Ylikangas | E04F 15/02038 |
| 2021/0207635 | A1 * | 7/2021 | Håkansson | E04B 1/6141 |
| 2023/0080262 | A1 * | 3/2023 | Håkansson | F16B 12/125 403/375 |

FOREIGN PATENT DOCUMENTS

| | | | |
|---|---|---|---|
| EP | 2236694 | A1 | 10/2010 |
| EP | 2270291 | A1 | 1/2011 |
| EP | 2751356 | A1 | 7/2014 |
| WO | 2007/008139 | A1 | 1/2007 |
| WO | 2021/246945 | A1 | 12/2021 |
| WO | 2022/197234 | A1 | 9/2022 |

OTHER PUBLICATIONS

U.S. Appl. No. 19/174,449, filed Apr. 9, 2025, Lucas Larsson.
International Search Report and Written Opinion received for PCT Patent Application No. PCT/SE2023/050919, mailed on Oct. 23, 2023, 15 pages.
U.S. Appl. No. 17/697,334, filed Mar. 17, 2022, Fredrik Boo.
U.S. Appl. No. 18/069,320, filed Dec. 21, 2022, Lucas Larsson.
U.S. Appl. No. 18/313,110, filed May 5, 2023, Darko Pervan.
U.S. Appl. No. 18/222,449, filed Jul. 16, 2023, Christian Boo.
U.S. Appl. No. 18/242,312, filed Sep. 5, 2023, Roger Ylikangas.
U.S. Appl. No. 18/370,454, filed Sep. 20, 2023, Anders Nilsson.
U.S. Appl. No. 19/014,541, filed Jan. 9, 2025, Fredrik Boo.
U.S. Appl. No. 18/963,840, filed Nov. 29, 2024, Anders Nilsson.
Office Action received for Swedish Patent Application No. 2251094.5, mailed on Mar. 23, 2023, 9 pages.
U.S. Appl. No. 19/221,907, filed May 29, 2025, Christian Boo.
U.S. Appl. No. 19/221,987, filed May 29, 2025, Roger Ylikangas.
U.S. Appl. No. 19/642,984, Lucas Larsson, filed Apr. 9, 2026.

* cited by examiner

SET OF PANELS COMPRISING A LOCKING DEVICE

CROSS REFERENCE TO RELATED APPLICATIONS

The present application claims the benefit of Swedish application no. 2251094-5, filed on Sep. 21, 2022. The entire contents of Swedish application no. 2251094-5 are hereby incorporated herein by reference in their entirety.

TECHNICAL FIELD

The disclosure generally relates to a set of panels comprising a locking device. More specifically, the locking device comprises a separate tongue configured to cooperate with a tongue groove for vertical locking of edge portions of the panels. The panels may be building panels, floor panels, ceiling panels, furniture components or wall panels.

BACKGROUND

WO 2022/197234 A1 discloses panels comprising novel mechanical locking systems that allow for an easier disassembly of the panels. For example, the panels may be disassembled without using a tool and/or by applying a force to an edge of a panel with a tool.

However, there is still room for improvements of such mechanical locking systems, particularly in relation to specific types of flooring, such as having a larger thickness.

SUMMARY

It is therefore an object of at least embodiments of the present disclosure to provide a set of panels comprising a locking device that may be disassembled in an improved manner, such as without using a tool interacting with the locking device. For example, the disassembly may involve manual operations only.

Another object of at least embodiments of the present disclosure is to provide an easier and/or faster disassembly or reassembly of a set of panels.

These and other objects and advantages that will be apparent from the description have been achieved by the various aspects, embodiments and examples described below.

In accordance with the disclosure, there is provided a set of panels, such as building panels, comprising a first panel and a second panel and a locking device for locking a first edge portion of the first panel to a second edge portion of the second panel. The panels comprise a front side and a rear side, wherein a normal of a main plane extending along the front and/or the rear side defines a vertical direction, preferably extending away from the front sides of the first and second panels. The locking device comprises a horizontal locking device and a vertical locking device. The vertical locking device comprises a separate tongue arranged in an insertion groove of the first edge portion, wherein a longitudinal extension of the separate tongue extends along the first edge portion, and a tongue groove provided in, and extending along, the second edge portion. In a vertically locked state of the first and second edge portions, an abutment member provided at a longitudinal end portion of the separate tongue cooperates with a stop surface of the second edge portion, and a locking portion of the separate tongue cooperates with the tongue groove.

In accordance with the disclosure, in the vertically locked state a transverse extension of the separate tongue from the insertion groove may be larger at the locking portion than at the longitudinal end portion. The edge portions may thereby be locally essentially vertically unlocked at the longitudinal end portion and the preferably flexible separate tongue may be gradually inserted into the tongue groove along the edge portions for providing their vertical locking.

Moreover, in accordance with the disclosure, the first and second panels may be disassembled by vertically displacing the first and second edge portions in a direction away from each other, preferably by means of a scissor or folding displacement, starting proximate to a location of the abutment member. For example, the edge portions may be vertically unlocked by a relative vertical displacement of the first and second edge portions away from each other, preferably essentially manually, optionally using a raising element under the second panel. During unlocking by means of the folding displacement, the separate tongue may be gradually displaced into the insertion groove along the first edge portion. In view of the above, it may be easier and/or less time consuming to disassemble or reassemble the panels. Particularly, a separate tool interacting with the locking device may not be needed during the disassembly, even though this is not excluded. As will be outlined elsewhere herein, the edge portions may in some embodiments be unlocked by repeatedly vertically displacing them away and towards each other. A separate tool may be suitable for disassembling certain fragile panels, such as porous panels, which may risk becoming damaged during a manual disassembly.

The stop surface may prevent a displacement of the separate tongue outwards from the insertion groove, preferably at least in a horizontal direction. The stop surface may further be a guiding surface, for example guiding the separate tongue during locking.

The stop surface may include an area of the second edge portion which cooperates with the separate tongue in the locked state, optionally also including an area which cooperates with the separate tongue during locking and/or unlocking.

Generally herein, cooperating surfaces may cooperate by direct engagement or indirectly. Examples of such cooperating surfaces include the stop surface and a surface of the abutment member. In any embodiment described herein, there may be a sealing agent, such as a wax or an adhesive, provided between the cooperating surfaces, thereby providing examples of an indirect engagement.

The abutment member may be provided in an outer and preferably in a lower portion of the separate tongue.

The abutment member may project downwards.

In some embodiments, opposing longitudinal end portions of the separate tongue may both comprise an abutment member. Hence, the abutment member may be one of at least two abutment members, and opposing longitudinal end portions of the separate tongue both comprise a respective one of the at least two abutment members. Thereby, the separate tongue may assume a curved, preferably essentially symmetrical, shape in the vertically locked state. Moreover, an unlocking of the edge portions may be initiated from either side thereof. Additionally, it may be suitable for use when several types of panels are included in the set for locking them to each other in a pattern, such as a herringbone pattern, e.g., including so-called A- and B-panels. Here, the separate tongue may include an abutment member facing a preferred part or side of the edge portion, such as a specific corner portion, regardless of the type of panel it is inserted into.

The first edge portion of the first panel and the second edge portion of the second panel may be short edge portions. In some embodiments, however, the edge portions may be long edge portions. Generally herein, the short edge portions may be shorter than the long edge portions.

The stop surface may be disposed below the tongue groove.

The stop surface may be disposed outside an opening of the tongue groove.

The locking portion of the separate tongue may be spaced from the stop surface in the vertically locked state.

The stop surface may be planar and may extend essentially vertically, such as vertically. By extending essentially vertically, the stop surface may preferably form an angle of 0°-10°, such as 0°-5° or 0°-2°, with respect to the normal N. Thereby, the cooperation between the abutment member and the stop surface may provide little or even no vertical locking of the edge portions. Hence, a simpler assembly and/or disassembly of the panels may be provided.

The abutment member may be pretensioned against the stop surface in the vertically locked state. For example, the separate tongue may comprise flexible members. A pretensioning of the separate tongue may cause it to be biased outwards, such as by a spring force. By means of the abutment members, the separate tongue may assume a longitudinally curved or bent form such that its longitudinal end portion(s) cooperate(s) with the stop surface(s) of the second edge portion, and its locking portion cooperates with the tongue groove.

Preferably, the separate tongue is flexible.

The separate tongue may comprise flexible members configured to face an inner portion of the insertion groove when arranged therein. The flexible members may be configured to displace the separate tongue outwards during locking or unlocking.

During locking, the second edge portion, preferably a lower cooperating surface, may cooperate, preferably directly, with the locking portion for displacing the separate tongue into the insertion groove.

During locking, the locking portion may be configured to be gradually inserted into the insertion groove along the first edge portion in a first stage, and in a second subsequent stage the locking portion may be configured to be gradually inserted into the tongue groove along the second edge portion.

The abutment member and the locking portion of the separate tongue may be operatively coupled such that, during locking, the second edge portion pushing the locking portion in a direction toward an inner portion of the insertion groove causes the abutment member to move together with the locking portion in the direction toward the inner portion of the insertion groove.

The abutment member may comprise a straight portion extending in parallel with a longitudinal extension of the separate tongue and preferably being arranged longitudinally inside of a longitudinally curved section provided in the longitudinal end portion(s). By means of the straight portion, a larger contact surface with the second edge portion may be provided. Thereby, the risk of damaging fragile panels, such as porous panels, for example panels comprising particle boards or OSB boards, during locking and/or unlocking may become reduced.

The flexible members may each extend from a respective base portion of the separate tongue. Each flexible member may extend from and may be bendable around the respective base portion. In some embodiments, a flexible member extending from a base portion arranged at the longitudinal end portion may extend from and may be bendable around a longitudinal inner side of the base portion. Thereby, a smaller force may be needed for displacing the separate tongue at the longitudinal end portion, and hence an easier unlocking may be obtained.

The abutment member may be at least partially, such as entirely, arranged longitudinally outwards from the flexible members. Thereby, an outwardly directed pressure from the flexible members may become smaller at the location of the abutment member, and it may become easier to unlock the edge portions.

The separate tongue, preferably the locking portion of the separate tongue, may be longitudinally bent in the vertically locked state.

The horizontal locking device may comprise a locking element arranged on a strip extending horizontally outwards from a lower portion of the first edge portion and a locking groove provided in the second edge portion. The locking element and the locking groove may be configured to cooperate to provide a horizontally locked state of the first and the second edge portions.

The first and second edge portions may be configured to be vertically unlocked by a, preferably forced, relative vertical displacement of the first and second edge portions away from each other and/or by a repeated, preferably forced, relative vertical displacement of the first and second edge portions away and towards each other. The repeated relative vertical displacement may comprise a jerking displacement of the edge portions up and down. By means of the repeated displacement, preferably by means of a folding displacement, the unlocking of the edge portions may in some embodiments become more controlled. Indeed, a portion of the separate tongue may become jammed after a first relative vertical displacement of the edge portions away from each other, thereby obtaining partially unlocked edge portions, and a second relative vertical displacement of the edge portions towards each other may at least partially release the separate tongue from the jamming; thereafter, a third relative vertical displacement of the edge portions away from each other may follow, whereby the edge portions may become further unlocked. As a further advantage, by means of the relative vertical displacement a risk of damaging the edge portions, such as at their decorative layers, and/or the locking device may become reduced. Indeed, a too excessive force from a relative vertical displacement directed in a single direction might only damage the edge portions or the locking device, especially for fragile panels.

In some embodiments, the abutment member may be provided in an outer and preferably upper portion of the separate tongue. Such embodiments are largely analogous to the embodiments described elsewhere herein where the abutment member is provided in an outer and lower portion, whereby reference is made thereto. Nevertheless, any or both of the following embodiments may be exchanged for the corresponding embodiments disclosed above: the abutment member and/or the stop surface may be inclined; the stop surface may be disposed in an upper portion of, or vertically above, the tongue groove.

The first and second panels may be resilient panels. The resilient panels may comprise a core comprising a polymer material, such as a thermoplastic material. The thermoplastic material may be foamed. The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. In some embodiments, the core may comprise at least two layers.

The first and second panels may comprise a decorative layer, such as a decorative foil comprising a thermoplastic material. The thermoplastic material of the decorative layer may be or comprise PVC, polyester, PP, PE, PS, PU, PET, polyacrylate, methacrylate, polycarbonate, polyvinyl butyral, polybutylene terephthalate, or a combination thereof.

The decorative foil preferably is printed, for example by direct printing, rotogravure, or digital printing.

The first and second panels may comprise a wear layer such as a film or foil. The wear layer may comprise thermoplastic material. The thermoplastic material may be PVC, polyester, PP, PE, PS, PU, PET, polyacrylate, methacrylate, polycarbonate, polyvinyl butyral, polybutylene terephthalate, or a combination thereof.

The first and second panels may comprise a wood-based core, such as a high-density fibreboard, HDF, a medium-density fibreboard, MDF, a particle board, an oriented strand board, OSB, or a plywood board.

Generally, all terms used herein, such as in the claims, are to be interpreted according to their ordinary meaning in the technical field, unless explicitly defined otherwise. All references to "a/an/the [element, member, device, component, means, step, etc.]" are to be interpreted openly as referring to at least one instance of said element, device, component, means, step, etc., unless explicitly stated otherwise. Reference to one or a plurality of "at least one element", etc., may shortly be referred to as "the element(s)".

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Figure 1A:
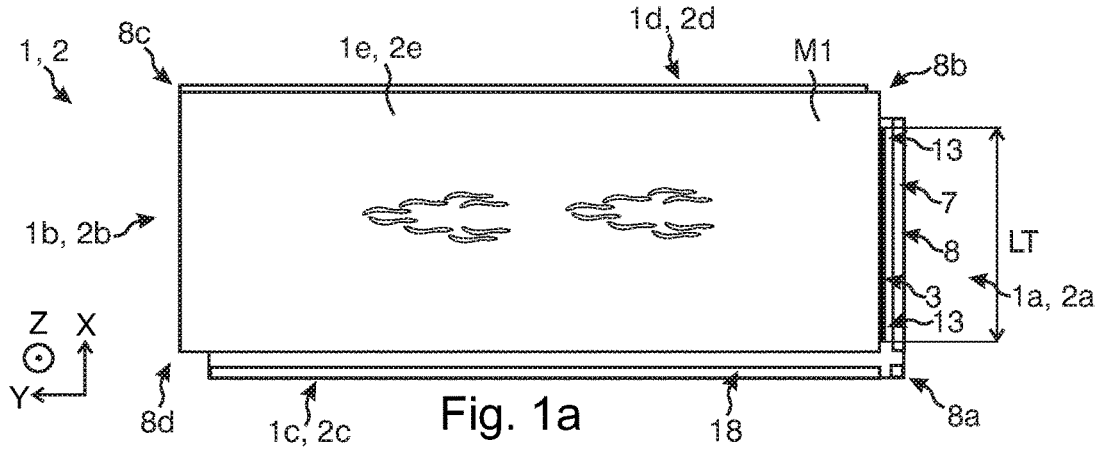
FIGS. 1*a*-1*e* illustrate in top views embodiments of a panel (FIGS. 1*a*-1*b*) and embodiments of assembled panels (FIGS. 1*c*-1*d*), and in a perspective view an embodiment of panels during assembly or disassembly (FIG. 1*e*).

In the following, various embodiments of the disclosure will be described with reference to the embodiments in, e.g., FIGS. 1*a*-1*e*, 2*a*-2*f*, 3*a*-3*d*, 4*a*-4*e*, 5*a*-5*e*, 6*a*-6*e*, 7*a*-7*f*, 8*a*-8*f*, 9*a*-9*f*, 10*a*-10*e*, 11*a*-11*d*, 12*a*-12*d*, 13*a*-13*d* and 14*a*-14*d*.

The disclosure relates to a set of panels, such as building panels, comprising a first 1 and a second 2 panel comprising a first 1*a* and a second 2*b* edge portion, respectively, see, e.g., FIGS. 1*a*-1*e* and 2*a*-2*f*. Preferably, the panels herein are essentially identical. For example, the panels may be floor panels, but wall panels, as illustrated in, e.g., FIG. 11*d*, or ceiling panels or furniture components are equally conceivable. The panels 1, 2 each comprise a front side 1*e*, 2*e* and a rear side if, 2*f*, preferably extending along a first X and a second Y perpendicular horizontal direction. For example, the first 1*a* and second 2*b* edge portions may extend along the first horizontal direction X. A normal N of a main plane M1, M2 extending along the front side 1*e*, 2*e* and/or the rear side if, 2*f* defines a vertical direction Z extending away from the front sides of the first 1 and second 2 panels.

The set of panels further comprises a locking device for locking the first 1*a* and second 2*b* edge portions to each other and obtaining a locked state. The locking device herein may be a mechanical locking device. Thereby, the first 1 and second 2 panels may be assembled to each other. The locking device comprises a horizontal locking device and a vertical locking device configured to define a horizontally and vertically locked state of the first 1*a* and second 2*b* edge portions, respectively.

The panels 1, 2 herein may be rectangular, but may in some embodiments also be square. Preferably, the first 1*a* and second 2*b* edge portions where the locking device is provided are short edge portions. It is clear that the panels 1, 2 may comprise opposing short edge portions 1*b*, 2*a* as shown in, e.g., FIG. 1*a*. The panels 1, 2 may further comprise third 1*c*, 2*c* and fourth 1*d*, 2*d* opposing edge portions, which preferably are long edge portions. For example, the third and fourth edge portions may extend along the second horizontal direction Y. However, embodiments in which the opposing edge portions 1*a*, 1*b*, 2*a*, 2*b* are long edge portions and the opposing edge portions 1*c*, 1*d*, 2*c*, 2*d* are short edge portions are included herein mutatis mutandis.

The set may comprise additional panels, such as a plurality of panels. For example, and as illustrated in, e.g., FIGS. 1*e*, 12*a* and 12*d*, the set may comprise a third panel 1' to which the panels 1, 2 may be assembled, such as along a third edge portion 1*c*', a fourth 1*d*' edge portion, and/or a first edge portion 1*a*'.

The panels 1, 2, such as floor panels, building panels, ceiling panels, furniture components or wall panels, may be configured to be arranged on, or connected to, a substructure, such as a subfloor 20. In some embodiments, the panels 1, 2 are floor panels which may be arranged on and along a subfloor 20, preferably in a floating manner. The horizontal directions X, Y may extend in parallel with the substructure, such as the subfloor, and the vertical direction Z may extend perpendicularly thereto, cf. FIG. 1*e*. Consequently, and as shown in, e.g., FIG. 11*d*, in the case of wall panels the horizontal directions X, Y may extend along a visible wall surface 21, typically provided perpendicularly to a subfloor 20 in an environment in which the wall panels are assembled, and the vertical direction Z may extend perpendicularly to the subfloor.

As shown in, e.g., FIGS. 1*a*-1*e*, 2*a*-2*f*, 4*c*, 5*d*-5*e*, 6*e*, 7*a*-7*f*, 8*a*-8*f*, 9*a*-9*f*, 10-10*e* and 11*a*, the vertical locking device comprises a separate tongue 3 arranged in an insertion groove 4 of the first edge portion 1*a* and a tongue groove 5 provided in the second edge portion 2*b*. The insertion groove, the separate tongue and the tongue groove may each have an elongated shape and may have a transverse extension and a preferably larger longitudinal extension. The longitudinal extensions of the insertion groove 4 and the separate tongue 3 may extend along the first edge portion 1*a* and the longitudinal extension of the tongue groove 5 may extend along the second edge portion 2*b*. For example, the edge portions 1*a*, 2*b* may extend along the first horizontal direction X. A cross-section of the locking device may be essentially constant along the edge portions 1*a*, 2*b*, except possibly in corner portions 8*a*, 8*b*, 8*c*, 8*d* of the panels 1, 2.

The separate tongue 3 may comprise a longitudinal end portion 3*a* and a locking portion 6. In some embodiments, and as shown in, e.g., FIGS. 1*c*, 3*a*, 4*a*, 4*d*, 5*a*, 6*a*, and 11*b*-11*c* and 14*a*-14*d*, the locking portion 6 may be a longitudinal inner portion of the separate tongue, preferably being provided between a pair of longitudinal end portions 3*a*. For example, the locking portion 6 may be a longitudinal central portion of the separate tongue. As shown in, e.g., FIGS. 1*d* and 6*d*, however, the locking portion 6 may in some embodiments extend to an opposing longitudinal end portion 3*a*, preferably without an inclusion of an abutment member 13. The separate tongue 3 thereby comprises an abutment member 13 provided at one or both longitudinal end portions 3*a*. Moreover, the second edge portion 2*b* comprises a stop surface 12.

In the vertically locked state, the abutment member 13 cooperates, such as engages, with the stop surface 12 and the locking portion 6 cooperates, such as engages, with the tongue groove 5. For example, a tip portion 3*i* of the separate tongue 3 may cooperate with the tongue groove 5 at a locking surface 5*g*, cf. FIG. 2*d*. The locking surface 5*g* may form an angle ε with respect to the main plane M2 (which for clarity is parallel transported downwards in FIGS. 2*c*-2*d*). Preferably $10° \leq \varepsilon \leq 50°$, more preferably $25° \leq \varepsilon \leq 40°$. Moreover, in the vertically locked state a, preferably outermost, underside 3*j* of the tip portion 3*i* may form an angle σ with respect to the main plane(s) M1 and/or M2. Preferably $0° \leq \sigma \leq 25\pi$, more preferably $0° \leq \sigma \leq 10°$, such as $3° \leq \sigma \leq 7°$.

In the vertically locked state, a distance D2 from an inner portion 4*a*, such as an innermost portion, of the insertion groove 4, to the stop surface 12 may be smaller than a distance D1 from the inner portion 4*a*, such as the innermost portion, to the locking surface 5*g* with which the separate tongue 3, for example the outermost section of the tip portion 3*i*, cooperates. The distances D1 and D2 may be measured along the second horizontal direction Y. In non-limiting examples, the difference D1–D2 may be 0.1-3.0 mm, preferably 0.3-0.9 mm.

The locking portion 6 of the separate tongue 3 may be flexible. Indeed, it may be bent in the vertically locked state, such as an outermost surface 3*m* thereof being convex, as may be seen most clearly by the curves Q and Q' in FIGS. 1*c*, 1*d*, 4*a* and 4*c*. For example, the outermost surface 3*m* may be specified in a top view of the first panel 1. By being longitudinally bent, a transverse length TL of the locking portion 6 from the insertion groove 4 along a transverse direction T of the separate tongue may be larger than a transverse length TE of the end portion(s) 3*a* from the insertion groove 4, see, e.g., FIG. 4*c*. Alternatively, or preferably additionally, by being longitudinally bent the separate tongue 3 may be curved around the normal N of the main plane M1 and/or around an axis AP extending perpendicularly to a groove plane GP arranged along an inner wall 4*c* of the insertion groove 4, cf. FIGS. 1*c*-1*e*, 2*f*, 4*c* and 5*d*. The longitudinal bending and/or the distances D1, D2 may be measured by a CT scanner, preferably in a central plane parallel to the main plane(s) M1 and/or M2.

Figure 5A:
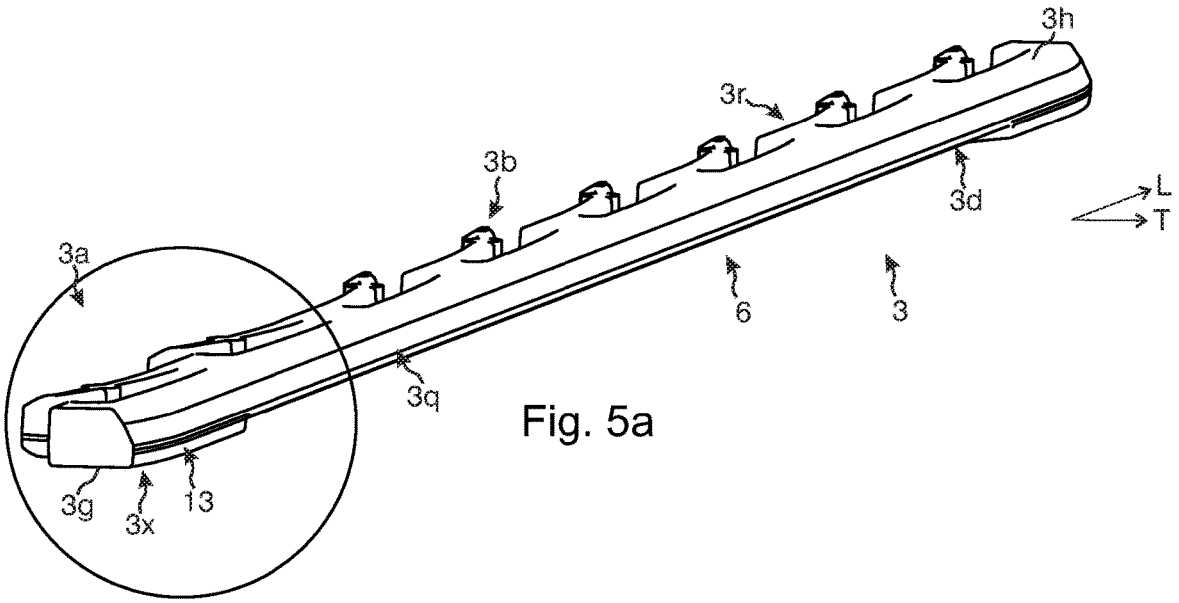
FIGS. 5*a*-5*c* illustrate in a perspective view (FIG. 5*a*), a side view (FIG. 5*b*), and a corresponding enlarged perspective view (FIG. 5*c*) an embodiment of a separate tongue.
Figure 5B:
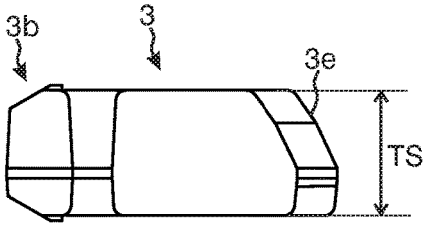
Figure 5C:
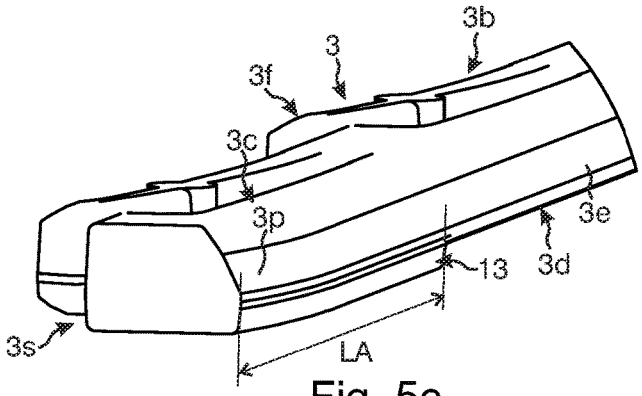
Figure 5D:
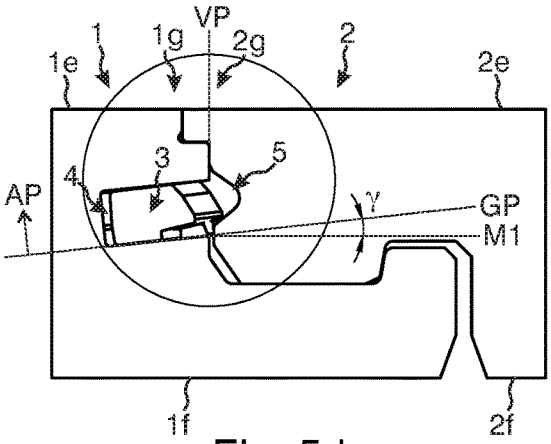
FIGS. 5*d*-5*e* illustrate an embodiment of a set of panels in a side view (FIG. 5*d*) and a corresponding enlarged side view (FIG. 5*e*).

As shown in, e.g., FIGS. 2a-2f, 3a-3d, 4c-4e, 5a-5e, 6a-6e, 7a-7f, 8a-8f, 9a-9f and 14a- 14d, the abutment member 13 may be provided in a preferably transversely outer and lower portion of the separate tongue 3. The abutment member 13 may project downwards, such as from a tongue body portion 3c. In a first example, it may be formed essentially as a hook or a tooth 13b. In a second example, and as illustrated in FIGS. 6a-6c, it may comprise at least two, such as three, teeth 13b.

The tongue body portion 3c may comprise a continuous longitudinal outer section 3q, preferably extending along substantially the entire longitudinal extension L of the separate tongue 3, see, e.g., FIGS. 3a, 4a, 4d, 5a, 6a, 6d, 11b-11c and 14a-14d.

As shown in, e.g., FIGS. 10a-10e and 11a-11c, the abutment member 13 may in some embodiments be provided in a preferably transversely outer and upper portion of the separate tongue 3.

Figure 2A:
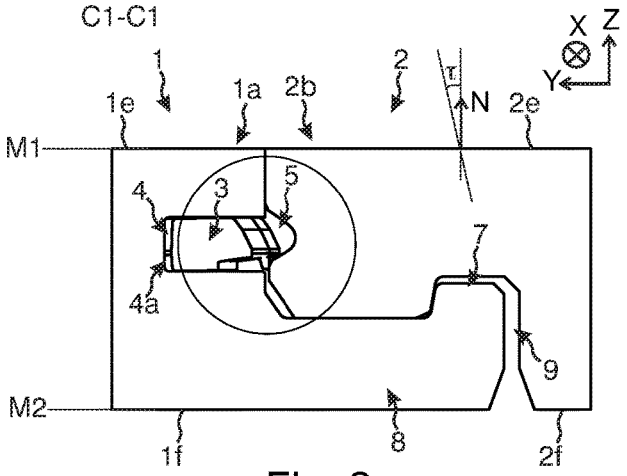
FIGS. 2*a*-2*f* illustrate an embodiment, e.g., of the panels in FIGS. 1*c*-1*d*, in a side view C1-C1 (FIG. 2*a*) and cross-sectional side views C2-C2 and C3-C3 (FIGS. 2*c* and 2*e*), and in a corresponding enlarged side view (FIG. 2*b*) and enlarged cross-sectional side views (FIGS. 2*d* and 2*f*).
Figure 2B:
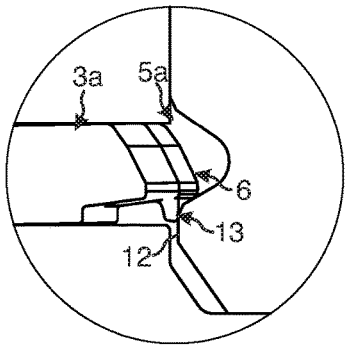
Figure 2C:
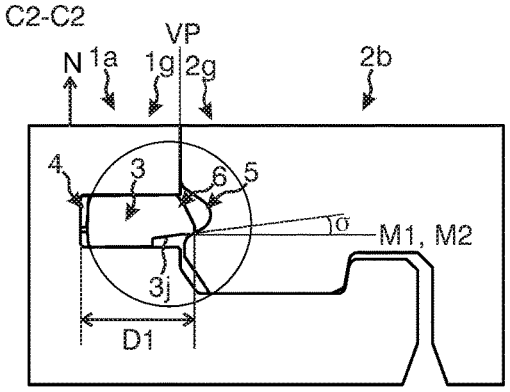
Figure 2D:
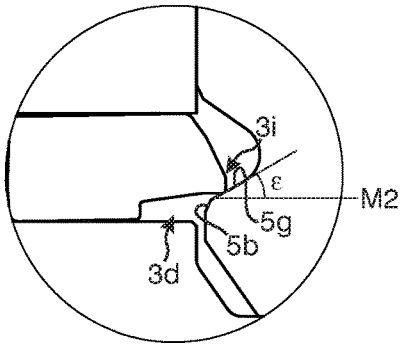
Figure 2E:
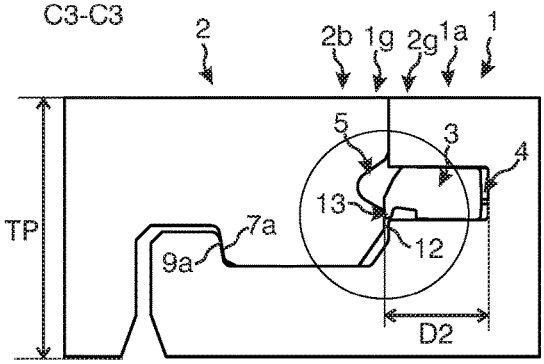
Figure 2F:
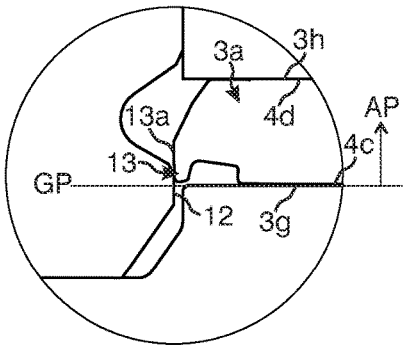
Figure 3A:
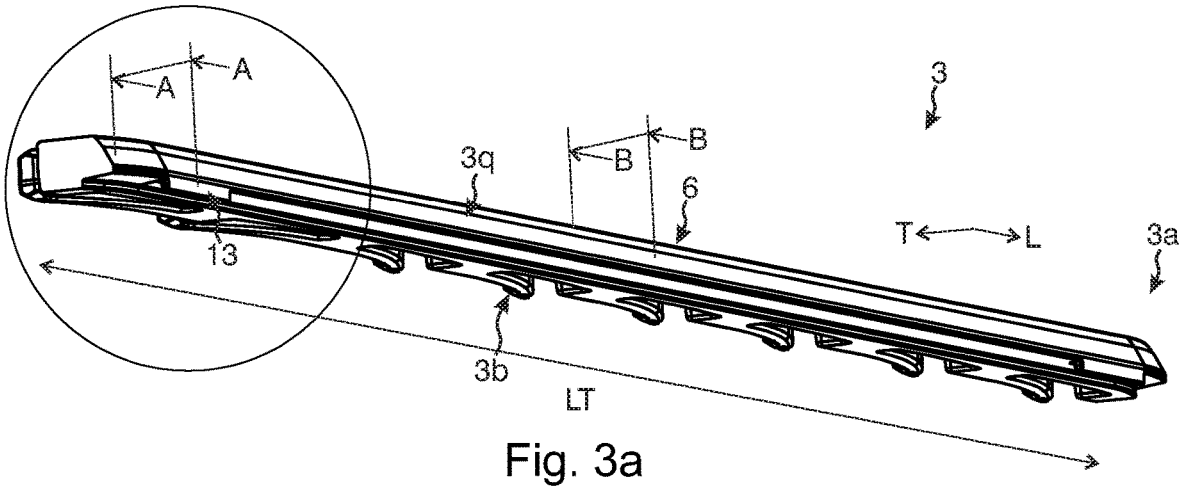
FIGS. 3*a*-3*d* illustrate an embodiment of a separate tongue in a perspective view (FIG. 3*a*), a corresponding enlarged perspective view (FIG. 3*b*), and cross-sectional side views along the sections A-A (FIG. 3*c*) and B-B (FIG. 3*d*) in FIG. 3*a*, FIGS. 4*a*-4*b* illustrate in a top view (FIG. 4*a*) and a corresponding enlarged top view (FIG. 4*b*) an embodiment of a separate tongue in an unlocked state and in a locked state of the edge portions.
Figure 3B:
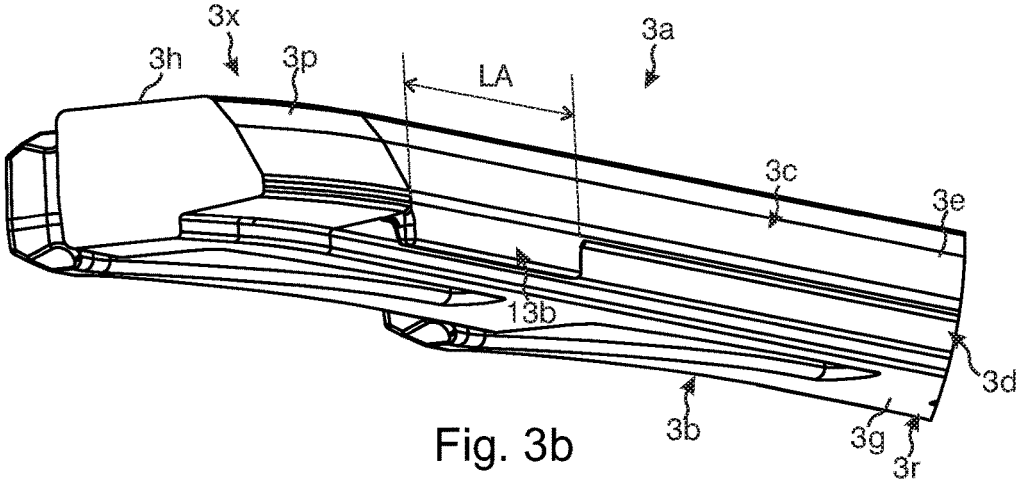
Figure 3C:
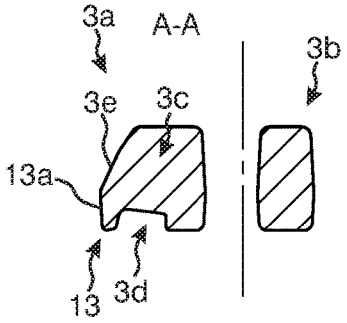
Figure 3D:
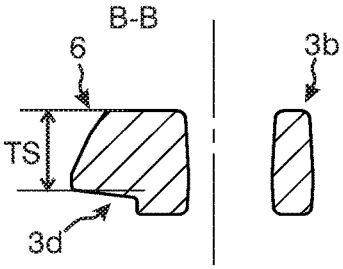

Furthermore, in the locked state the abutment member 13 may in some embodiments be provided at or above the groove plane GP arranged along the inner wall 4c, see, e.g., FIG. 2f. The inner wall 4c may be a vertically lower wall. In some embodiments, the abutment member 13 may be provided at or below a groove plane GQ arranged along an opposite inner wall 4d of the insertion groove 4, see, e.g., FIG. 11a. The inner wall 4d may be a vertically upper wall. In any of these embodiments, the abutment member 13 may be displaced into the insertion groove 4 during locking.

In some embodiments, and as shown in, e.g., FIGS. 2a-2f, 3a-3d, 4d-4e, 5a-5e, 6a-6e, 7a-7f, 8a-8f, 9c-9f, 10a-10e, 11a-11b and 14c-14d, a, preferably transversely, outer portion of the separate tongue 3 may comprise a longitudinally extending cavity 3d. The cavity 3d may be disposed transversely behind the abutment member 13, such as at the longitudinal end portion(s) 3a, and may face downwards when the separate tongue 3 is arranged in the insertion groove 4. By means of the cavity, a thickness, such as an outer thickness, TS of the separate tongue and hence a thickness TG of the tongue groove 5 may be reduced. Also, a weight and/or cost of the separate tongue may potentially be reduced. The cavity 3d may extend along essentially an entire longitudinal length LT of the separate tongue 3, such as to the longitudinal end portion 3a or a longitudinal distal end thereof. In some embodiments, however, and as shown in, e.g., FIGS. 5a-5c, 11c and 14c-14d, the thickness TS, such as of the tongue body portion 3c, may be substantially constant at the longitudinal end portion(s) 3a, such as being absent of a cavity 3d. Such a separate tongue may be simpler to manufacture. Optionally, the locking portion 6 may comprise a cavity 3d, cf., FIGS. 5a-5c and 14c-14d.

In some embodiments, e.g., in FIGS. 10a-10e and 11a-11c, the outer portion of the separate tongue 3 may comprise a longitudinally extending upper cavity 3n, preferably being arranged longitudinally inwardly of the abutment member(s) 13.

The abutment member 13 may be flexible along the transverse extension T of the separate tongue 3. For example, the flexibility may be achieved by means of the cavity 3d. Thereby, a simpler unlocking of the edge portions 1a, 2b may be obtained.

In some embodiments, opposing longitudinal end portions 3a of the separate tongue 3 both comprise an abutment member 13, see, e.g., FIGS. 1a-1c, 2a-2f, 3a-3d, 4a-4e, 5a-5c, 6a-6c, 7a-7f, 8a-8f, 9a-9f, 10a-10e, 11a-11c and 14a-14c. The edge portions 1a, 2b may thereby become unlocked from either side. In some embodiments, however, only a single longitudinal end portion 3a of the separate tongue 3 comprises an abutment member 13, see, e.g., FIGS. 1b, 1d, 6d-6e, 7a-7f, 8a-8f, 9a-9f, 10a-10e and 11a. The edge portions 1a, 2b may thereby preferably become unlocked from one side. It is understood that any of these alternatives are equally conceivable herein.

By way of example, a longitudinal length LA of the abutment member 13, such as along the longitudinal extension L of the separate tongue 3, may be 1-20 mm, preferably 5-10 mm or 1-6 mm, more preferably 3-6 mm, cf., FIGS. 3a-3b, 4e and 5c. It is noted that a larger longitudinal length LA may imply a reduced vertical locking strength, but a simpler unlocking. Generally herein, the vertical locking strength must be sufficiently high for obtaining a functioning locking device along the edge portions; at the same time, the vertical locking strength has to be at least locally configured so that the edge portions may be unlocked.

The stop surface 12 may be disposed vertically below the tongue groove 5, as shown, e.g., in FIGS. 2a-2b, 2e-2f, 5d-5e, 6b, 7a-7f, 8a-8f and 9a-9f. Additionally, or alternatively, the stop surface 12 may be disposed outside an opening 5a of the tongue groove 5. The opening 5a may extend horizontally to a vertical plane VS provided along the stop surface 12, such as an innermost portion thereof, optionally extending horizontally to a vertical plane VP provided in the locked state along joining upper portions 1g, 2g of the edge portions 1a, 2b, see, e.g., FIGS. 2c, 5d, 7d-7e, 9b and 9d. With respect to the second panel 2, the vertical plane VS may be provided horizontally inside of the vertical plane VP, see, e.g., FIG. 9b. Optionally, the tongue groove 5, such as the opening 5a, may comprise at least one bevel 5b, cf., FIGS. 2b, 2d and 2f. Thereby, the stop surface 12 may be disposed outside of the bevel. The bevel 5b may be positioned adjacent to the locking surface 5g and may form a groove guiding surface.

In some embodiments, and as shown, e.g., in FIGS. 10a-10e and 11a, the stop surface 12 may be disposed in an upper portion of, or vertically above, the tongue groove 5. The stop surface 12 may be disposed at or outside the opening 5a. For example, the stop surface 12 may be part of an upper bevel 5b of the tongue groove 5, cf., FIGS. 10a-10b and 11a.

Figure 1B:
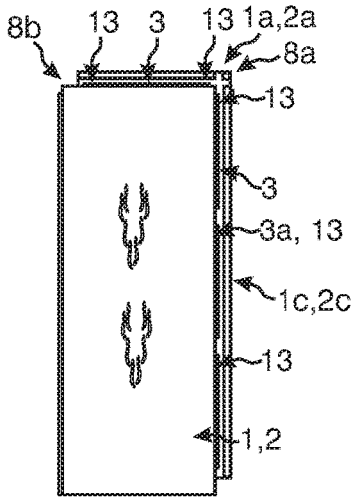
Figure 1C:
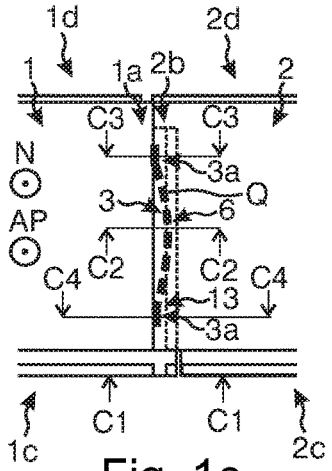
Figure 1D:
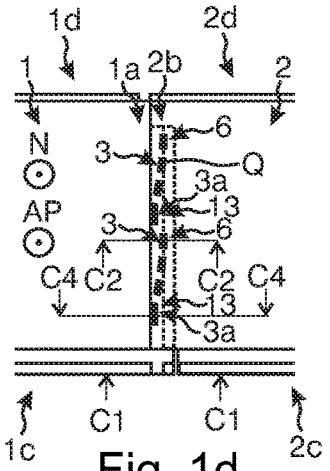
Figure 1E:
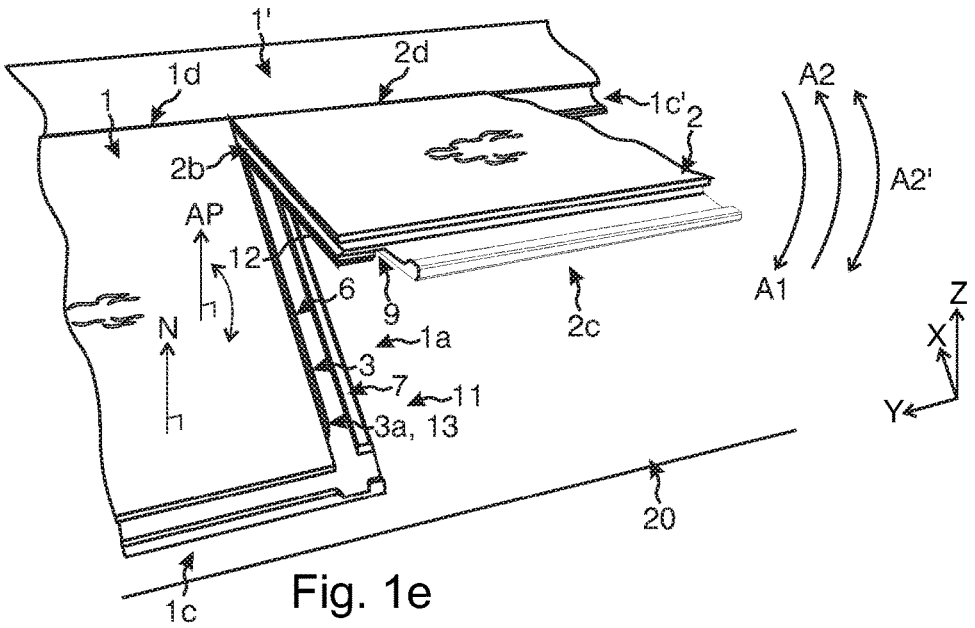
Figure 12A:
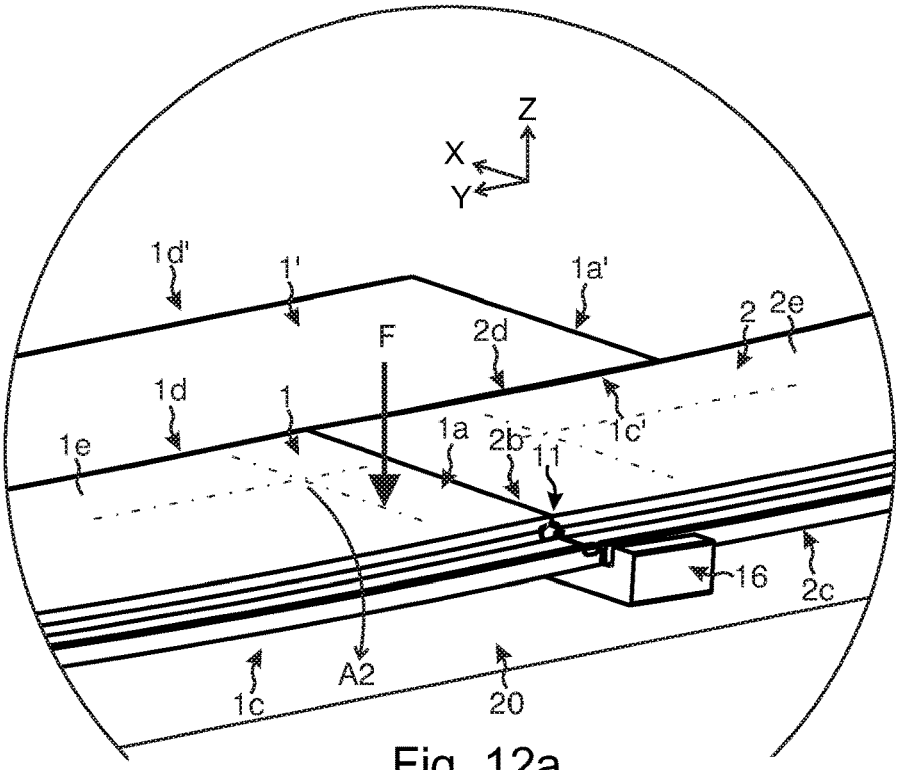
FIGS. 12*a*-12*c* illustrate in perspective views an embodiment of a set of panels during disassembly (FIGS. 12*a*-12*b*) and an embodiment of a raising element (FIG. 12*c*).
Figure 12B:
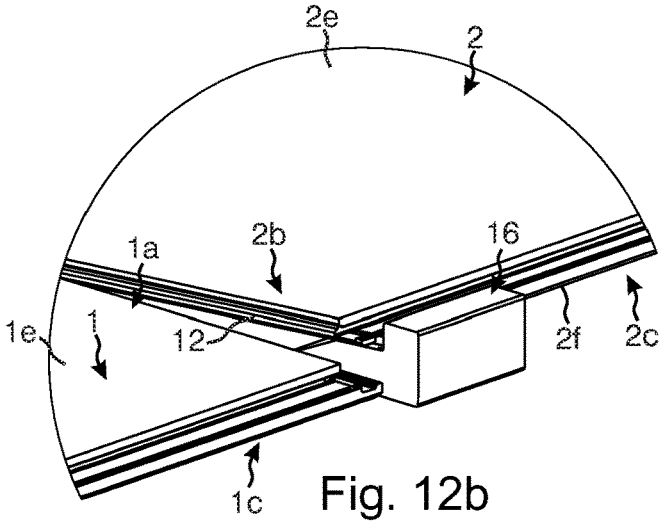

The stop surface 12 in any embodiment herein may be an edge surface and may extend along the second edge portion 2b, preferably with a constant cross-section therealong, cf., FIGS. 1e and 12b. The locking portion 6 may be spaced from the stop surface 12 in the vertically locked state, see, e.g., FIGS. 2c-2d, 10b and 10e.

As shown in, e.g., FIGS. 2b, 2f, 5e, 7f, 8b, 9b and 9d, at least a portion of, such as the entire, stop surface 12 may be planar, preferably extending essentially vertically, such as vertically. By extending essentially vertically, the stop surface 12 may form an angle $\tau$ of 0°-10°, such as 0°-5° or 0°-2°, with respect to the normal N, cf. FIG. 2a.

The stop surface 12 in, e.g., FIGS. 10a-10e and 11a-11c may be planar and inclined, for example by an angle of $0° \leq \delta \leq 45°$, such as $10° \leq \delta \leq 30°$, with respect the vertical direction Z. In some embodiments, a portion of the stop surface 12 may be planar and mainly vertical. For example, the stop surface 12 may be formed by a sharp corner section between a joining surface 2k of the second edge portion 2b and an upper wall 5h of the tongue groove 5, e.g., being provided about 90° with respect to each other.

In some embodiments, and as schematically illustrated in FIGS. 2b, 2f, 7f, 8f, 9b and 9d, the abutment member 13, such as an outer surface 13a thereof, may in the locked state extend essentially vertically, preferably with respect to the vertical direction Z. A simpler unlocking may thereby be provided, preferably together with an essentially vertical, such as vertical, stop surface 12.

Figure 5E:
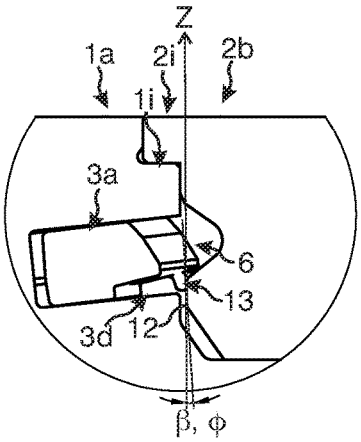
Figure 6A:
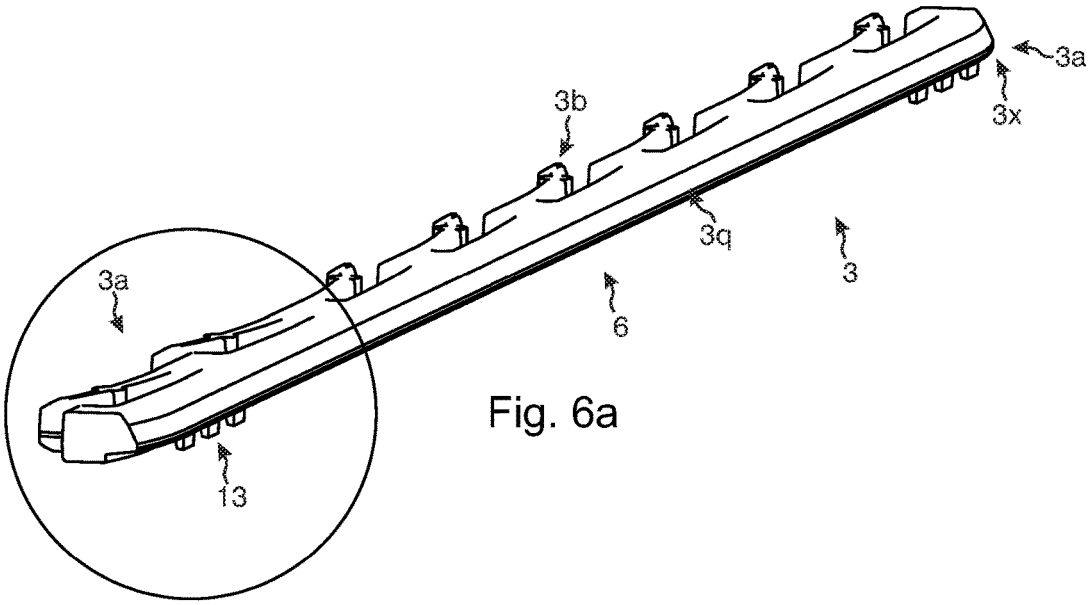
FIGS. 6*a*-6*c* illustrate in a perspective view (FIG. 6*a*), a side view (FIG. 6*b*), and a corresponding enlarged perspective view (FIG. 6*c*) an embodiment of a separate tongue and its cooperation with the second edge portion.
Figure 6B:
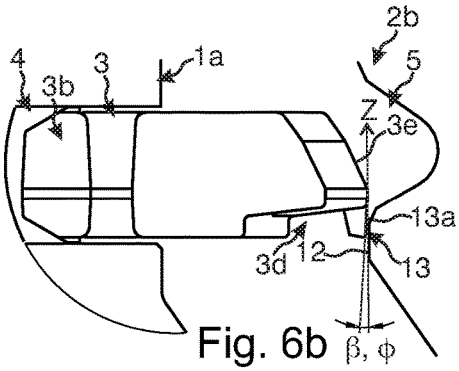
Figure 6C:
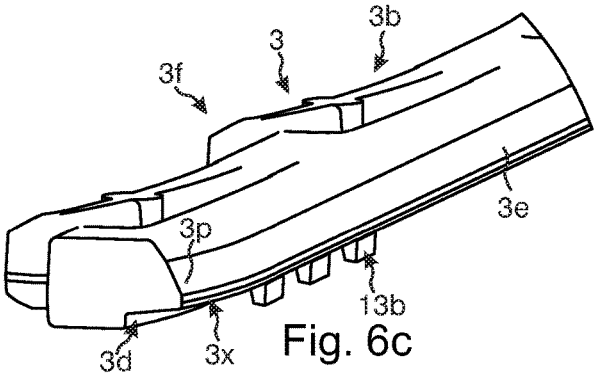
Figure 6D:
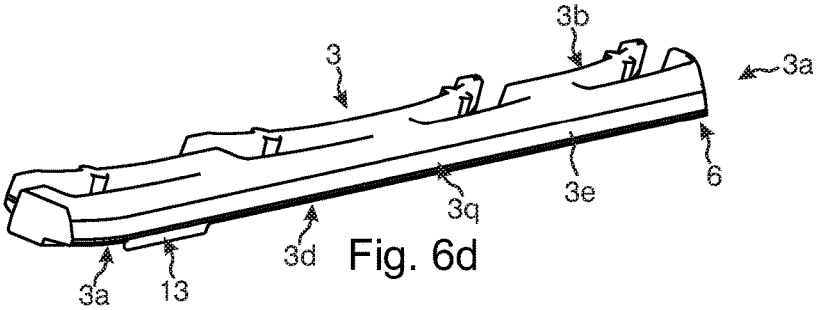
FIGS. 6*d*-6*e* illustrate in perspective views an embodiment of a separate tongue (FIG. 6*d*) and an embodiment of two such separate tongues arranged in an insertion groove (FIG. 6*e*).

In some embodiments, however, and as schematically illustrated in FIGS. 5*e* and 6*b*, the abutment member 13, such as the outer surface 13*a*, may in the locked state be inclined by an angle β, preferably with respect to the vertical direction Z. In a first example, and as shown in FIG. 6*b*, the angle may be negative, such that the outer surface 13*a* is inclined inwards, e.g., with a range of $0° \leq \beta \leq 10°$, such as $1° \leq \beta \leq 5°$. In a second example, and as shown in FIG. 5*e*, the angle may be positive, such that the outer surface 13*a* is inclined outwards, e.g., with a range of $0° \leq \beta \leq 10°$, such as $1° \leq \beta \leq 5°$.

Alternatively, or additionally, to an inclined abutment member 13, in some embodiments the stop surface 12 may be inclined. There may be a relative angle ϕ between the stop surface and the abutment member in the locked state, cf. FIGS. 5*e* and 6*b*. A non-zero relative angle ϕ may provide a simpler disassembly of the panels. For example, a negative relative angle may be $-10° \leq \phi < 0°$, such as $-5° \leq \phi \leq -1°$. A positive relative angle ϕ may additionally provide a larger bending of the separate tongue 3, whereby a smaller locking length of the separate tongue may be obtained and, for example, a simpler unlocking. For example, $0° < \phi \leq 10°$, such as $1° \leq \phi \leq 5°$.

The abutment member 13 in, e.g., FIGS. 10*a*-10*e* and 11*a*-11*c* may be planar and inclined, for example by an angle of $0° \leq \theta \leq 45°$, such as $10° \leq \theta \leq 30°$, with respect the vertical direction Z in the locked state. For example, the shapes of the stop surface 12 and the outer surface 13*a* may substantially correspond to each other.

A pair of oppositely arranged displacement surfaces 3*g*, 3*h* of the separate tongue 3 may vertically position the separate tongue in the insertion groove 4, preferably by cooperating with its inner walls 4*c*, 4*d*. Moreover, the displacement surfaces 3*g*, 3*h* may be configured to be displaced against the inner walls 4*c*, 4*d* during locking or unlocking, the displacement preferably being directed along the transverse extension T of the separate tongue and/or along the groove plane GP or GQ.

The separate tongue 3 may comprise flexible members 3*b*, such as flexible legs, configured to face the inner portion 4*a* of the insertion groove 4 when arranged therein. The flexible members 3*b* may be bendable (see arrow BE in FIGS. 4*b* and 14*a*-14*b*) between an inner 3*k* and an outer 31 position, preferably along a tongue insertion direction and/or tongue displacement direction of the insertion groove, which may be parallel with the transverse extension T of the separate tongue. Thereby, the separate tongue 3 may be displaceable between an inner and an outer position of the insertion groove. An inwardly directed pressure applied on the separate tongue 3 may displace it inwards toward the inner position during locking (see arrows B1) or unlocking (see arrows B2) and the flexible members 3*b* may be configured to displace it outwards during locking (see arrows B1') or unlocking (see arrows B2') toward its outer position, e.g., by virtue of a biasing force of the flexible members 3*b*. For example, the separate tongue may be compressed.

The separate tongue 3 may comprise a polymer-based material, such as thermoplastic material, e.g., PP, and optionally a reinforcing element, such as glass fibres. For example, the separate tongue may be formed by injection moulding. Optionally, it may comprise at least one friction element 3*f* for preventing it from being displaced out from the insertion groove 4. The friction element 3*f* may be shaped as a local protrusion which is arranged on one or several flexible members 3*b*, preferably extending perpendicularly outwards from any or both of the displacement surfaces 3*g*, 3*h*. The cooperation between the stop surface 12 and the abutment member 13 may prevent the separate tongue from being displaced into the tongue groove 5 at the longitudinal end portion(s) 3*a*. Preferably, the abutment member 13 is pretensioned against the stop surface 12 in the vertically locked state.

Figure 6E:
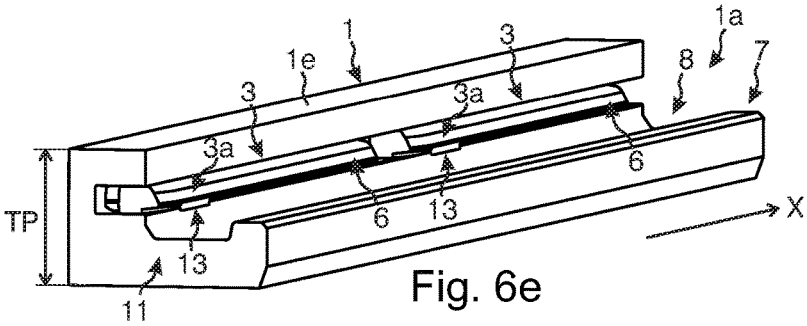
Figure 7A:
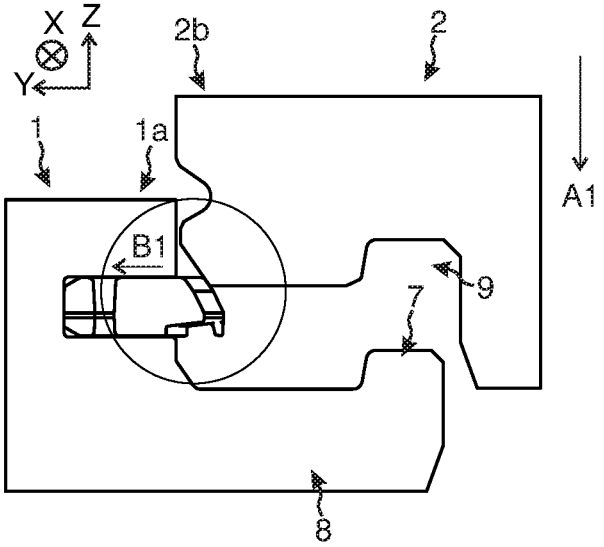
FIGS. 7*a*-7*f* illustrate in side views (FIGS. 7*a*, 7*c* and 7*e*) and corresponding enlarged side views (FIGS. 7*b*, 7*d* and 7*f*) an embodiment of a first and a second edge portion during locking.
Figure 7B:
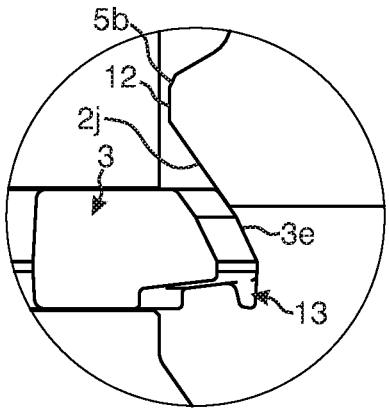
Figure 7C:
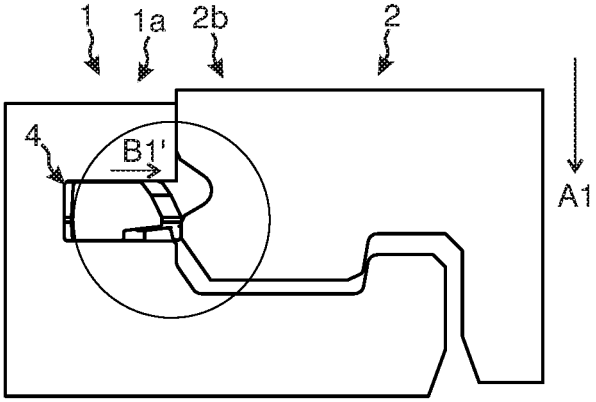
Figure 7D:
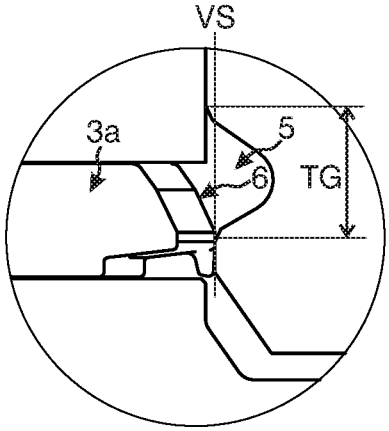
Figure 7E:
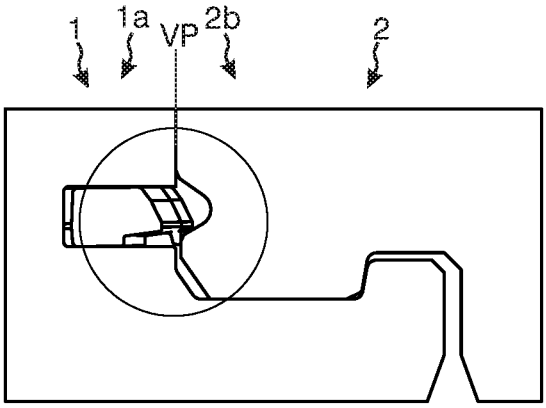
Figure 7F:
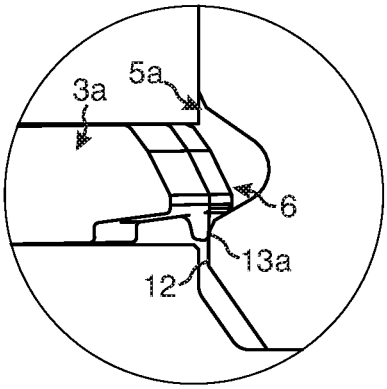
Figure 8A:
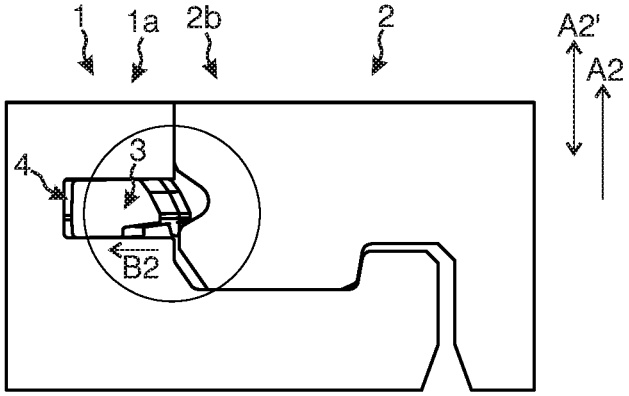
FIGS. 8*a*-8*f* illustrate in side views (FIGS. 8*a*, 8*c* and 8*e*) and corresponding enlarged side views (FIGS. 8*b*, 8*d* and 8*f*) an embodiment of a first and a second edge portion during locking or unlocking.
Figure 8B:
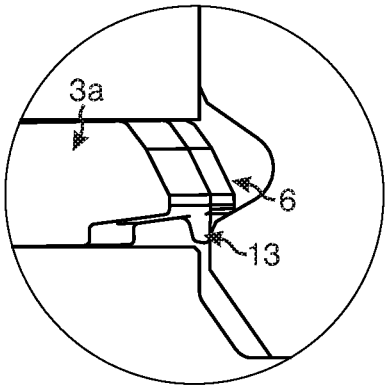
Figure 8C:
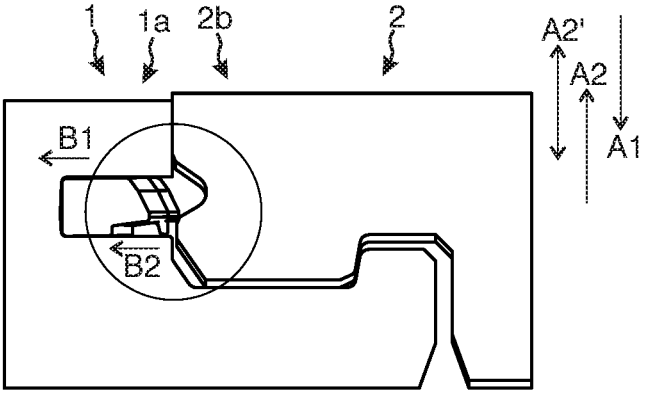
Figure 8D:
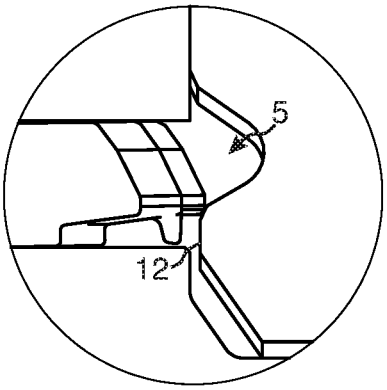
Figure 8E:
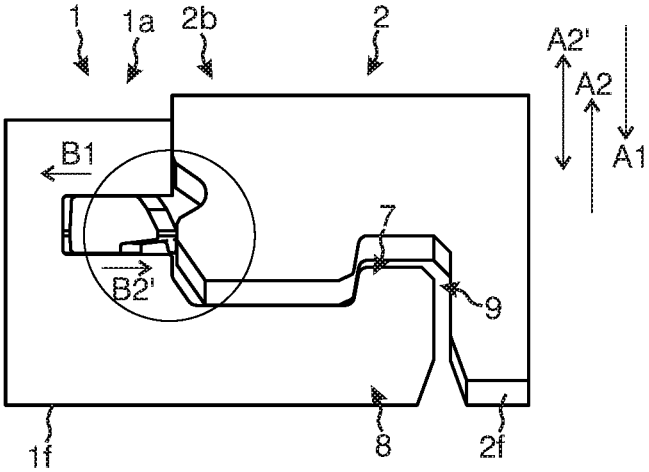
Figure 8F:
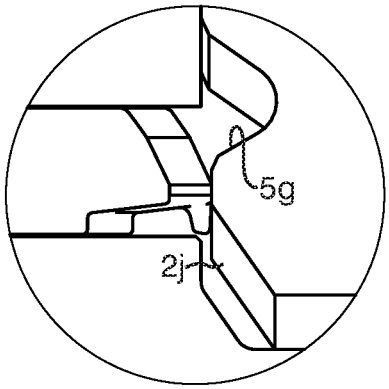

In some embodiments, and as illustrated in FIGS. 1*b*, 1*d* and 6*e*, at least two separate tongues 3, such as a plurality of separate tongues, may be arranged in the insertion groove 4. The separate tongues 3 may be arranged side-by-side along the first edge portion 1*a*, 2*a*, such as along the first horizontal direction X, and/or, as shown in FIG. 1*b*, along the third edge portion 1*c*, 2*c*. For example, the first edge portion 1*a*, 2*a* may be a short edge portion, but a long edge portion is equally conceivable. It is noted that the locking device on the third 1*c*, 2*c* and fourth 1*d*, 2*d* edge portions, e.g., in FIG. 1*b*, may be embodied similarly to the locking device on the first 1*a*, 2*a* and second 1*b*, 2*b* edge portions, such as in FIGS. 2*a*-2*f*.

The separate tongues 3 comprising an abutment member 13 at a single longitudinal end portion 3*a* may each be oriented in a similar manner in the insertion groove 4, such as having the abutment member 13 of each separate tongue located at the same longitudinal end portion 3*a*, cf., FIG. 6*e*. Thereby, each of the separate tongues may be properly displaced into and out of the insertion groove 4 along the entire length of the first edge portion 1*a*. Also, the edge portions 1*a*, 2*b* may become capable of being unlocked.

A skilled artisan will appreciate that in some embodiments at least two separate tongues 3, each comprising abutment members 13 at opposing longitudinal end portions 3*a*, may be arranged side-by-side in the insertion groove 4. For example, any of the separate tongues in FIGS. 2*a*-2*f*, 3*a*-3*d*, 4*a*-4*e*, 5*a*-5*e*, 6*a*-6*c*, 9*a*-9*f*, 10*a*-10*e*, 11*a*-11*c* and 14*a*-14*d* may be used.

Generally herein, such as in any of FIGS. 1*a*-1*e*, 2*a*-2*f*, 3*a*-3*d*, 4*a*-4*e*, 5*a*-5*e*, 6*a*-6*e*, 7*a*-7*f*, 8*a*-8*f*, 9*a*-9*f*, 10*a*-10*e*, 11*a*-11*d*, 12*a*-12*b* and 14*a*-14*d*, an abutment member 13 of a separate tongue 3 may be arranged in an end section 11 of the first edge portion 1*a*, which may be provided adjacent to the third edge portions 1*c*, 2*c*, cf., FIGS. 1*e*, 6*e* and 12*a*-12*b*. The end section 11 may be configured to be locked during a final stage of the locking (see arrows A1) of the edge portions 1*a*, 2*a* and/or unlocked during an initial stage of the unlocking (see arrows A2) of the edge portions 1*a*, 2*a*, preferably by means of a folding displacement.

In FIG. 1*b*, the longitudinal end portion 3*a* of the separate tongues 3 in the short 1*a*, 2*a* and long 1*c*, 2*c* edge portions may comprise an abutment member 13 on one longitudinal end portion 3*a*. Preferably, the abutment member of the separate tongue in the long edge portion is adjacent to a corner portion 8*a* where strips 8, 18 of the long and short edge portions meet (see below). Thereby, a risk of an involuntary unlocking of the long edge portions, e.g., in a middle section thereof, may become reduced. Moreover, the abutment member of the separate tongue in the short edge portion preferably is adjacent to the corner portion 8*a* and/or provided in the end section 11. Optionally, the separate tongue 3 in the short edge portion 1*a*, 2*a* may also comprise an abutment member 13 on the opposing longitudinal end portion 3*a* (see leftmost reference number 13 in FIG. 1*b*).

Figure 14A:
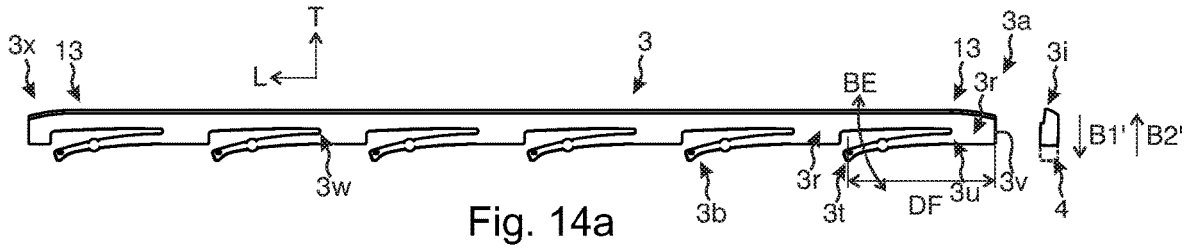
FIGS. 14*a*-14*b* illustrate in top views different embodiments of a separate tongue in an unlocked state.
Figure 14B:
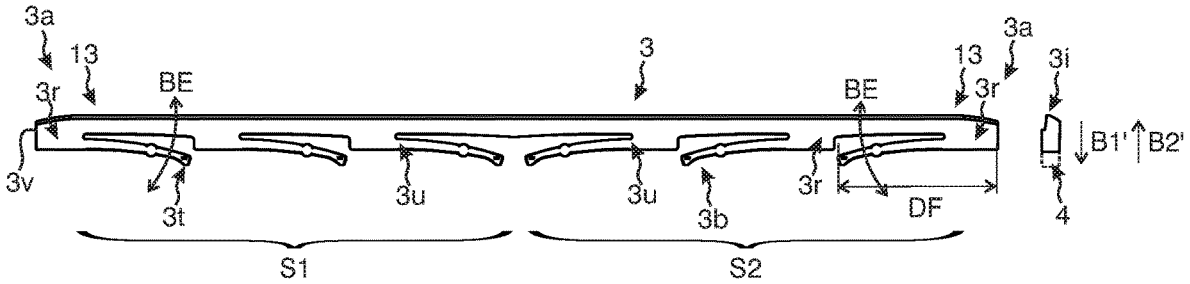

Generally herein, the flexible members 3*b* may each extend from a respective base portion 3*r* of the separate tongue 3. Each flexible member may extend from and may be bendable around the respective base portion 3*r*. As shown in FIGS. 14*a*-14*b*, a flexible member 3*b* extending from a base portion 3*r* arranged at the longitudinal end portion 3*a* may extend from and may be bendable around a longitudinal inner side 3*u* of said base portion 3*r*. The inner side 3*u* may be a region of the base portion 3*r* facing away from a nearest longitudinally outermost edge 3*v* of the separate tongue. In other words, an end segment 3*t* of the flexible member 3*b* may be directed towards the longitudinal central portion of the separate tongue 3. Hence, an unlocking starting at this longitudinal end portion 3*a* is preferred.

As shown in FIG. 14*a*, the flexible members 3*b* may all be oriented in the same direction, e.g., such that they all extend from the same longitudinal side, such as inner side 3*u* or outer side 3*w*, of the base portion 3*r*. FIG. 14*b* illustrates that in some embodiments a flexible member 3*b* extending from a base portion 3*r* arranged at a respective longitudinal end portion 3*a* may extend from and may be bendable around a longitudinal inner side 3*u* of the base portion 3*r*. Hence, an unlocking from either longitudinal end portion 3*a* may be equally preferred. As shown in FIG. 14*b*, the flexible members 3*b* may be grouped into two sets S1, S2 that are oppositely oriented, e.g., such that they extend from opposite longitudinal sides of the base portions 3*r* of the respective set S1, S2, such as the inner sides 3*u*. For example, a distance DF from the longitudinally outermost edge(s) to the flexible member 3*b*, such as to the end segment 3*t*, may be 5-30 mm, such as 10-20 mm.

Figure 14C:
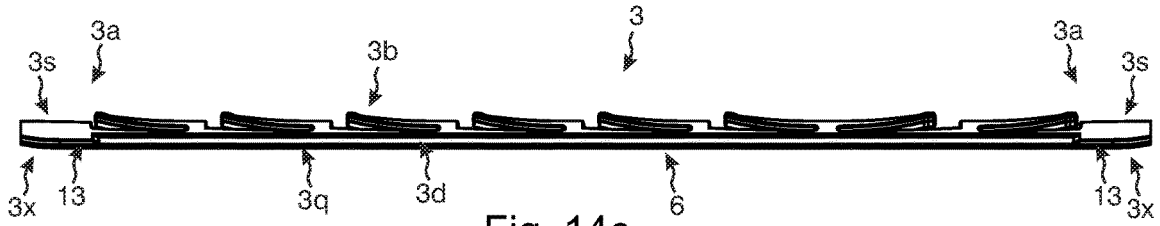
FIGS. 14*c*-14*d* illustrate an embodiment of a separate tongue in a perspective view (FIG. 14*c*) and in an enlarged perspective view (FIG. 14*d*) around its longitudinal end portion.
Figure 14D:
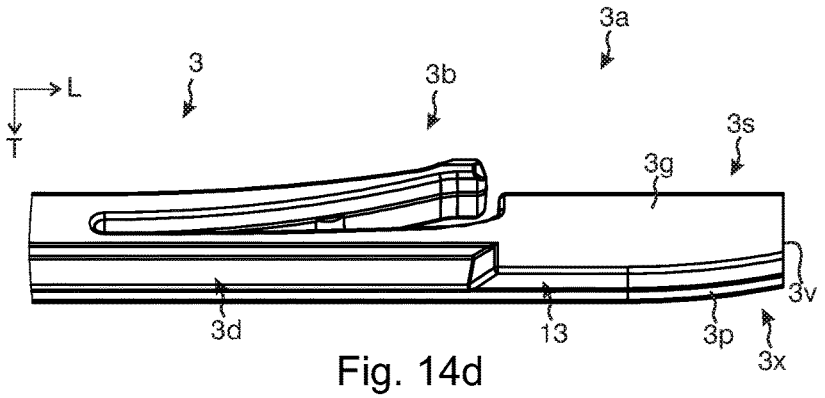

The abutment member 13 may in some embodiments be at least partially arranged longitudinally outwards from the flexible members 3*b*, see, e.g., FIGS. 14*c*-14*d*. For example, the abutment member 13 may be entirely arranged longitudinally outwards from the flexible members 3*b*. The separate tongue 3 preferably comprises support members 3*s* arranged longitudinally outwards from the flexible members 3*b*. The support members 3*s* may cooperate with the inner portion 4*a* during locking.

Figure 9A:
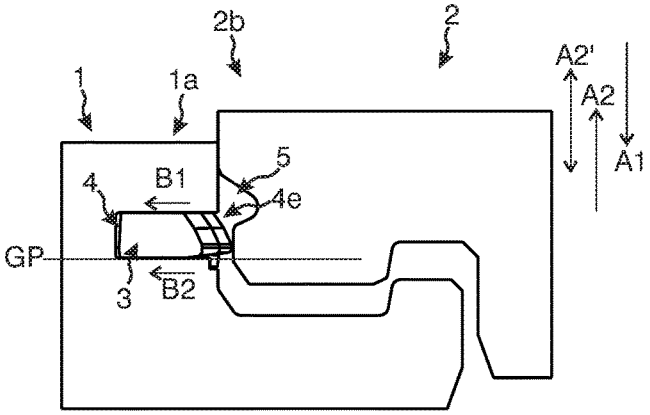
FIGS. 9*a*-9*b* illustrate in side views an embodiment of a first and a second edge portion during locking or unlocking.
Figure 9B:
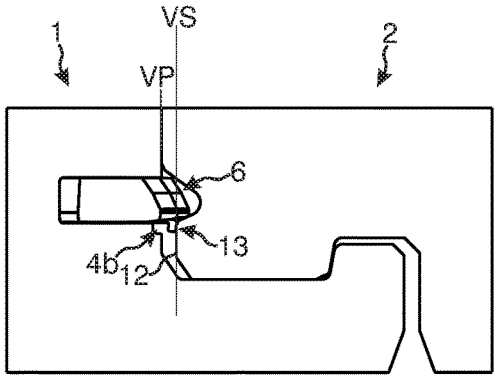
Figure 9C:
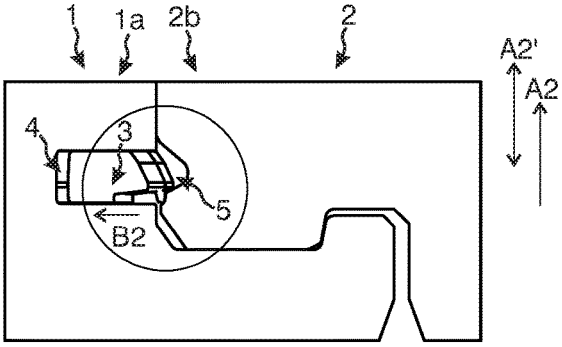
FIGS. 9*c*-9*f* illustrate in side views (FIGS. 9*c* and 9*e*) and corresponding enlarged side views (FIGS. 9*d* and 9*f*) an embodiment of a first and a second edge portion during locking or unlocking.
Figure 9D:
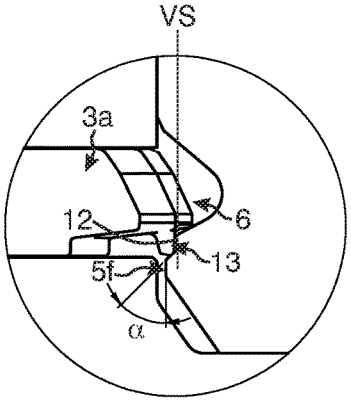
Figure 9E:
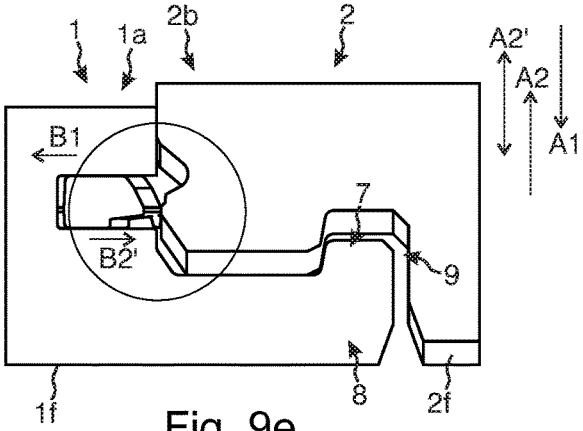
Figure 9F:
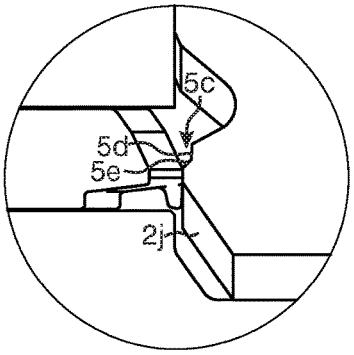
Figure 10A:
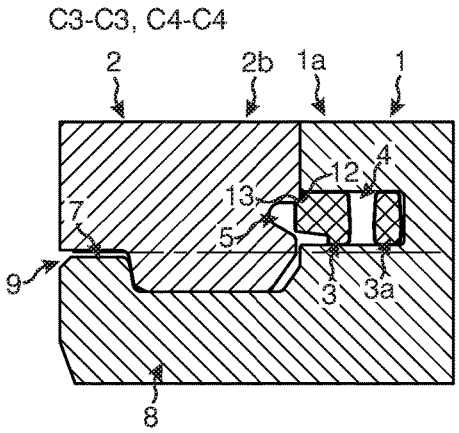
FIGS. 10*a*-10*b* illustrate in cross-sectional side views an embodiment of locked first and second edge portions, e.g., of the panels in FIGS. 1*c*-1*d*, in the cross-sectional side views C3-C3 and/or C4-C4 (FIG. 10*a*) and C2-C2 (FIG. 10*b*).
Figure 10B:
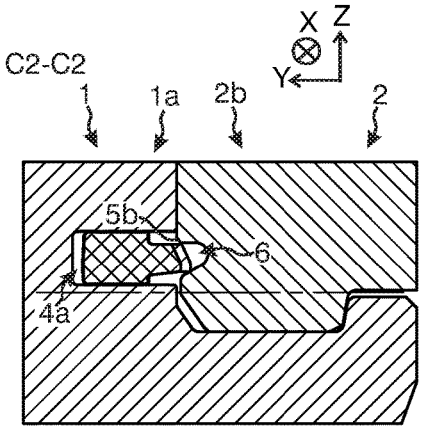
Figure 10C:
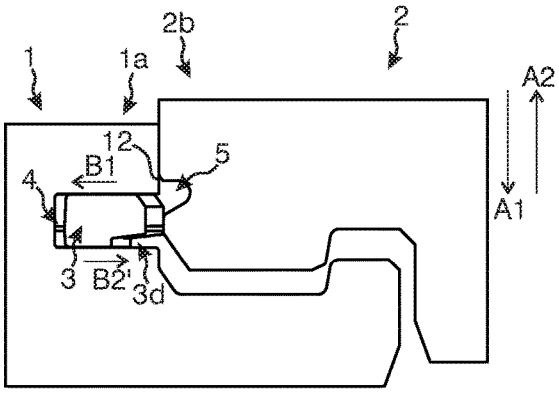
FIGS. 10*c*-10*e* illustrate in side views an embodiment of a first and a second edge portion during locking or unlocking.
Figure 10D:
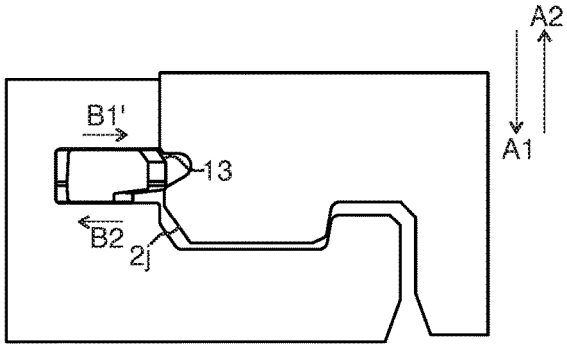
Figure 10E:
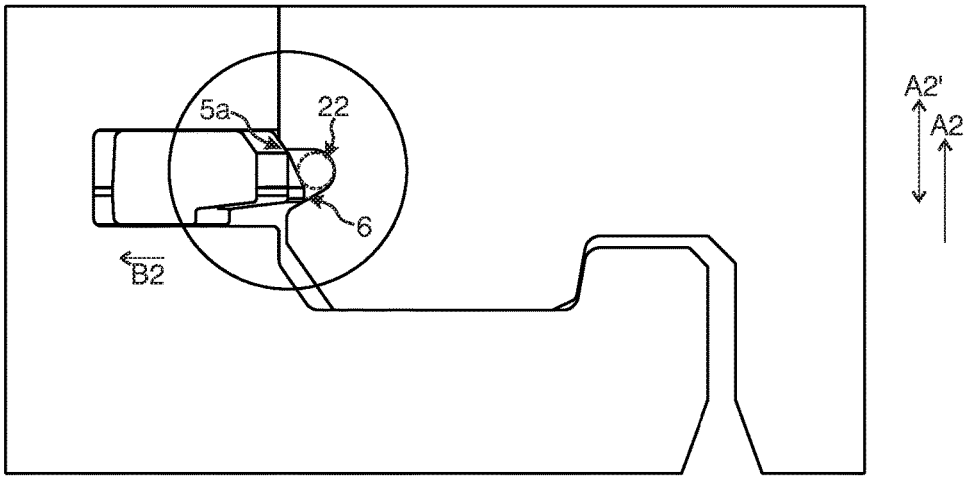
Figure 11A:
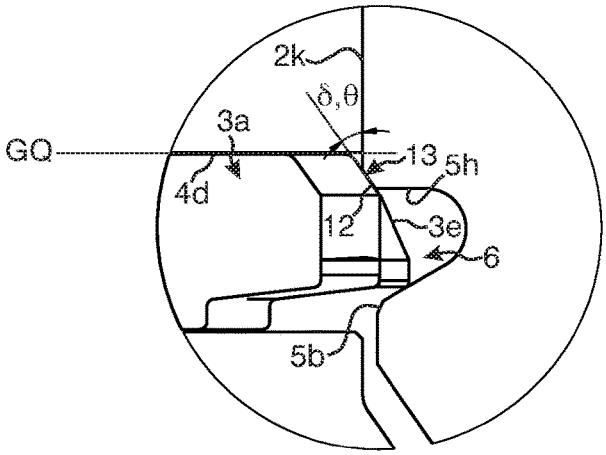
FIGS. 11*a*-11*b* illustrate an enlarged side view (FIG. 11*a*) of the edge portions in FIG. 10*e* and a perspective view (FIG. 11*b*) of the separate tongue therein.
Figure 11B:
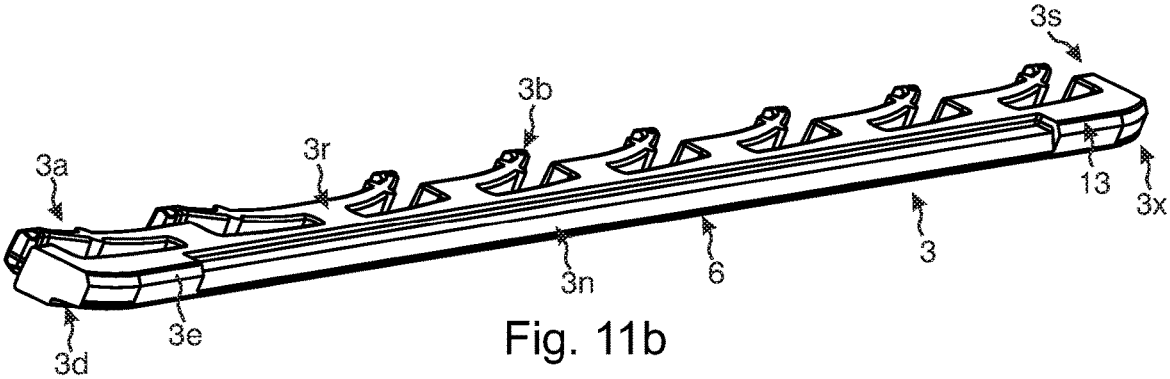
Figure 11C:
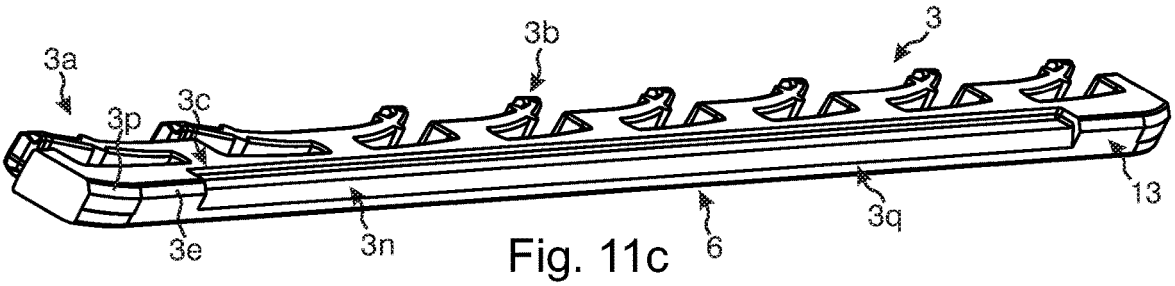
FIG. 11*c* illustrates an embodiment of a separate tongue in a perspective view.
Figure 11D:
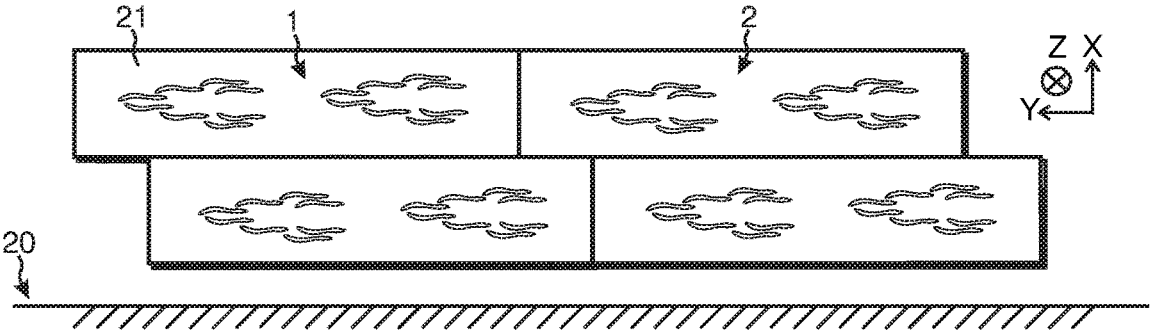
FIG. 11*d* illustrates an embodiment of assembled wall panels.

In some embodiments, the first edge portion 1*a* may comprise an auxiliary groove 4*b* for housing at least a portion of the abutment member 13 during locking, see FIGS. 9*a*-9*b*. The auxiliary groove 4*b* may be located under an opening 4*e* of the insertion groove 4 and may extend along the first edge portion 1*a*, at least at the location of the abutment member 13, such as along an entirety of the first edge portion. In the locked state, the abutment member 13 may thereby be at least partly, such as entirely, provided below the groove plane GP, see, e.g., FIG. 9*a*. The insertion groove may be provided above the groove plane GP. Thereby, the abutment member 13 may be displaced outside of the insertion groove 4 during locking.

In any of the embodiments herein, such as in FIGS. 1*a*-1*e*, 2*a*-2*f*, 4*c*, 5*d*-5*e*, 6*e*, 7*a*-7*f*, 8*a*-8*f*, 9*a*-9*f*, 10*a*-10*e*, 11*a*, 11*d*, 12*a*-12*b* and 14*a*-14*d*, the first edge portion 1*a* may comprise a strip 8 extending horizontally outwards from a lower portion thereof, such as along the second horizontal direction Y. The horizontal locking device may comprise a locking element 7 arranged on the strip 8, preferably extending upwards, and a locking groove 9 provided in the second edge portion 2*b*. The locking element 7 may be configured to cooperate, such as engage, with the locking groove 9 to provide a horizontally locked state of the first 1*a* and second 2*b* edge portions. For example, an inner portion 7*a* of the locking element 7 and an outer portion 9*a* of the locking groove 9 together with the joining upper portions 1*g*, 2*g* may lock the edge portions 1*a*, 2*b* in two opposite horizontal directions, such as along the second horizontal direction Y, cf., FIG. 2*e*.

In some embodiments, and as shown, e.g., in FIGS. 2*a*-2*f*, 7*a*-7*f*, 8*a*-8*f*, 9*a*-9*f*, 10*a*-10*e* and 11*a*, the inner walls 4*c*, 4*d* of the insertion groove 4 may extend essentially horizontally, such as being essentially parallel with the main plane M1. This may be preferred for thicker panels, such as floor panels, for example having a thickness TP of at least 10 mm, preferably 10-25 mm, more preferably 12-16 mm.

In some embodiments, and as shown in, e.g., FIGS. 5*d*-5*e*, the insertion groove 4 may be inclined by an angle γ. The angle γ may be defined as an inclination of the groove plane GP with respect to the main plane M1 (which for clarity is parallel transported downwards in FIG. 5*d*). For example, the angle γ, may be less than 20°, preferably 5-15°, such as 10°. This may be preferred for thinner panels, such as laminate floor panels, for example having a thickness not exceeding 10 mm, such as 8-10 mm.

A skilled artisan will appreciate that the above embodiments are exemplary and that any of the embodiments of the insertion grooves in the previous two paragraphs with angles γ=0 and γ>0, respectively, may be interchanged.

As shown in, e.g., FIGS. 9*c*-9*f*, the second edge portion 2*b* may comprise a recess 5*c* for accommodating the abutment portion 13 in the locked state. The stop surface 12 may be provided as an inner 5*d* and/or a lower 5*e* recess surface. Preferably, the recess 5*c* is provided below the tongue groove 5. The second edge portion 2*b* may further comprise a protrusion 5*f* provided below the recess 5*c*. The recess and/or the protrusion may extend along essentially the entire second edge portion, preferably with a constant cross-section. By means of the recess and/or protrusion, a simpler disassembly of the panels may be provided. In particular, a quicker displacement of the separate tongue 3 into the insertion groove 4 may be provided. In addition, the displacement may be more controlled.

Preferably, the inner 5*d* and/or the lower 5*e* recess surface(s) are/is planar. For example, the inner recess surface 5*d* may extend essentially vertically, such as 0°-10°, preferably 0°-5°. The lower recess surface 5*e* may extend at an angle α of $10° < \alpha \leq 45°$, preferably $10° \leq \alpha \leq 30°$, with respect to the vertical direction Z.

In some embodiments, the joining upper portions 1*g*, 2*g* may horizontally overlap. As shown in FIGS. 5*d*-5*e*, the second edge portion 2*b* may extend above the first edge portion 1*a*. For example, the first 1*a* and 2*b* edge portions may comprise a ledge portion 1*i* and a lap portion 2*i*, respectively, which cooperate, such as engage, with each other in the locked state. The joining upper portions 1*g*, 2*g* of the edge portions 1*a*, 2*b* along which the vertical plane VP may extend may in the embodiment in FIGS. 5*d*-5*e* be disposed along a horizontally outermost surface of the upper portion 1*g*, such as of the ledge portion 1*i*.

The first 1*a* and second 2*b* edge portions may be configured to be vertically locked to each other by a relative vertical displacement A1 of the first and second edge portions towards each other, such as displacing the second edge portion against the first edge portion. The relative vertical displacement A1 preferably comprises a folding displacement, or equivalently, scissor displacement (e.g., so-called fold down), whereby the second edge portion is gradually vertically displaced towards the first edge portion, see, e.g., FIGS. 1*e*, 7*a*-7*f*, 8*a*-8*f*, 9*a*-9*f* and 10*c*-10*e* (see arrows A1, starting with the lower figures in FIGS. 8*a*-8*f* and 9*c*-9*f*). By means of the folding displacement, the separate tongue 3, such as the locking portion 6, may in a first stage be gradually inserted into the insertion groove 4 along the first edge portion 1*a* and in a second subsequent stage gradually inserted into the tongue groove 5 along the second edge portion 2*b*. Clearly, the relative vertical displacement A1 may also lock the edge portions 1*a*, 2*b* horizontally, such as by means of the cooperating locking element 7 and locking groove 9.

During locking, the second edge portion 2*b*, preferably a lower cooperating surface 2*j*, may cooperate, preferably directly, with an outer cooperating surface 3*e* of the separate tongue 3 for displacing it into the insertion groove 4, see, e.g., FIGS. 7*a*-7*f*, 8*a*-8*f*, 9*c*-9*f* and 10*c*-10*e* (see arrows A1). For example, during locking, the second edge portion 2*b*, preferably the lower cooperating surface 2*j*, may cooperate, preferably directly, with the locking portion 6 for displacing separate tongue 3 into the insertion groove 4. The abutment member 13 and the locking portion 6 may be operatively coupled such that, during locking, the second edge portion 2*b* pushing the locking portion 6 in a direction toward the inner portion 4*a* causes the abutment member to move together with the locking portion in the direction toward the inner portion 4*a*. The lower 2*j* and outer 3*e* cooperating surfaces may be inclined, preferably with essentially corresponding inclinations. For example, the outer cooperating surface 3*e* may be arranged in the longitudinal outer section 3*q*. Moreover, the outer cooperating surface 3*e* preferably extends substantially along the entire longitudinal extension L. Optionally, the outer cooperating surface 3*e* may be chamfered at the longitudinal end portion(s) 3*a* by a chamfer 3*p*. Preferably, such a chamfer 3*p* may cooperate with the second edge portion 2*b* during locking for gradually inserting the separate tongue 3 into the insertion groove. The longitudinal end portion(s) 3*a* may comprise a longitudinally curved section 3*x* as seen from a top and/or bottom view of the separate tongue 3. The chamfer 3*p* may be arranged in the curved section 3*x*.

During locking, preferably during and/or between said first and second stages, at least one selected from the group of the stop surface 12, the bevel 5*b*, the inner 5*d*, the lower 5*e* recess surface and protrusion 5*f*, may cooperate with the separate tongue 3, such as with the tip portion 3*i* and/or the abutment member 13.

In any embodiment herein, the abutment member 13 may comprise a straight portion extending in parallel with the longitudinal extension L, optionally being entirely straight, see, e.g., FIGS. 3*a*-3*b*, 4*a*-4*e*, 5*a*-5*c*, 6*a*-6*e*, 11*b*-11*c* and 14*a*-14*d*. Preferably, the straight portion is arranged longitudinally inside of the longitudinally curved section 3*x* and/or the chamfer 3*p*.

During the relative vertical displacement A1, preferably folding displacement, a pair of third 1*c*, 1*c*', 2*c* and fourth 1*d*, 2*d* edge portions may be configured to be locked to each other by a relative angling displacement of the third and fourth edge portions against each other, such as by angling the third edge portion against the fourth edge portion, cf., FIG. 1*e*. The edge portions 1*c*, 1*c*', 2*c*, 1*d*, 2*d* may be vertically and horizontally locked to each other, for example by a locking device integrally formed with a core of the panels 1, 1', 2. For example, the edge portions may be interlocked by means of a cooperating tongue 14 and tongue groove 15 as well as a locking element 17 provided on a strip 18 cooperating with a locking groove 19, see, e.g., FIG. 12*d*. Alternatively, the edge portions may be interlocked analogously to the embodiments on the first 1*a*, 2*a* and second 1*b*, 2*b* edge portions described herein, such as in FIGS. 2*a*-2*f*, 5*d*-5*e*, 6*e*, 7*a*-7*f*, 8*a*-8*f*, 9*a*-9*f*, 10*a*-10*e* and 11*a*, whereby reference is made thereto. For example, a locking device on the third 1*c*, 2*c* and fourth 1*d*, 2*d* edge portions comprising one or several separate tongues 3, e.g., as in FIG. 1*b*, may be used. For other embodiments of the edge portions 1*c*, 1*c*', 2*c*, 1*d*, 2*d*, we refer to, e.g., page 2, lines 13-22 and FIGS. 1*a*-1*e* and 2*a*-2*e* in WO 2021/206611 A1 whose contents hereby are explicitly incorporated by reference.

The first 1*a* and second 2*b* edge portions may be configured to be vertically unlocked by a relative vertical displacement A2 of the first and second edge portions away from each other, preferably by means of a folding displacement, see, e.g., FIGS. 1*e*, 8*a*-8*f*, 9*e*-9*f* and 12*a*-12*b*. Alternatively, or additionally, the first 1*a* and second 2*b* edge portions may be configured to be vertically unlocked by a repeated relative vertical displacement A2' of the first and second edge portions away and towards each other, see, e.g., FIGS. 1*e*, 8*a*-8*f*, 9*c*-9*f* and 12*a*-12*c* (see arrows A2, A2', starting with the upper figures in FIGS. 8*a*-8*f* and 9*c*-9*f*). By means of the folding displacement, the separate tongue 3, such as the locking portion 6, may be gradually displaced out from the tongue groove 5 along the second edge portion 2*b* and inserted into the insertion groove 4 along the first edge portion 1*a*. Thereby, the edge portions 1*a*, 2*b* may be gradually unlocked from each other. Analogously with the discussion above, the relative vertical displacement A2, A2' may also unlock the edge portions 1*a*, 2*b* horizontally, such as by disengaging the locking element 7 from the locking groove 9. By unlocking the edge portions 1*a*, 2*b*, the first 1 and second 2 panels may be disassembled from each other.

During unlocking, the second edge portion 2*b* may cooperate with the separate tongue 3, such as the locking portion 6, for displacing it into the insertion groove 4, see, e.g., FIGS. 8*a*-8*f* and 9*c*-9*f* (see arrows A2). For example, at least one selected from the group of the stop surface 12, the bevel 5*b*, the inner 5*d*, the lower 5*e* recess surface and protrusion 5*f*, may cooperate with the separate tongue, such as with the tip portion 3*i* and/or the abutment member 13.

Figure 12C:
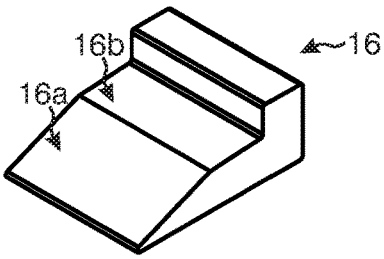
Figure 12D:
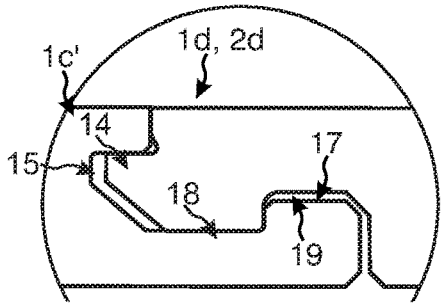
FIG. 12*d* illustrates in a side view an embodiment of interlocked third and fourth edge portions, such as those in, or obtainable, from FIG. 1*e*.
Figure 13A:
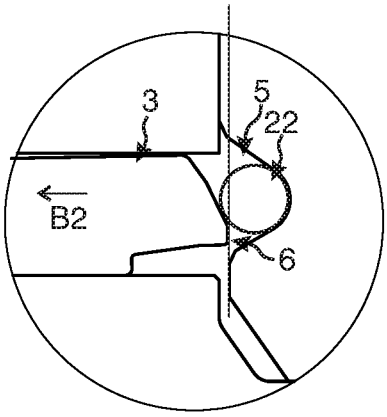
FIGS. 13*a*-13*d* illustrate in side views (FIGS. 13*a*-13*b*) an embodiment of a first and a second edge portion during unlocking using a separate tool, e.g., of the panels in FIGS. 1*c*-1*d*, in the cross-sectional side views C2-C2 (FIG. 13*a*) and C3-C3 and/or C4-C4 (FIG. 13*b*), and perspective views of an embodiment of such a separate tool (FIG. 13*c*) and its use (FIG. 13*d*).
Figure 13B:
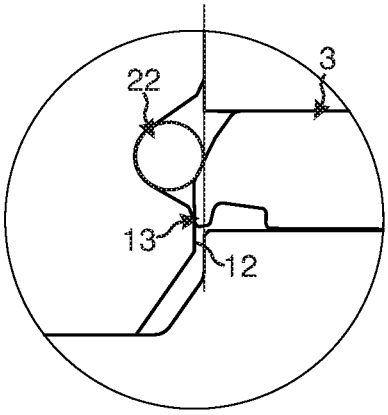
Figure 13C:
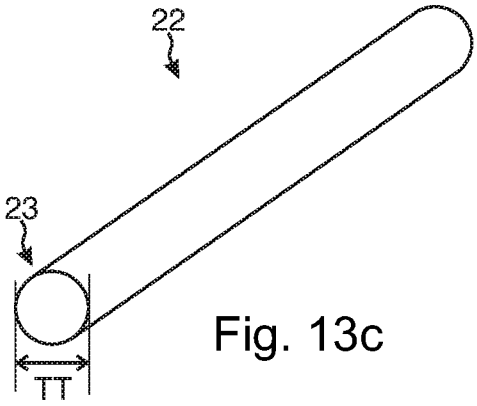
Figure 13D:
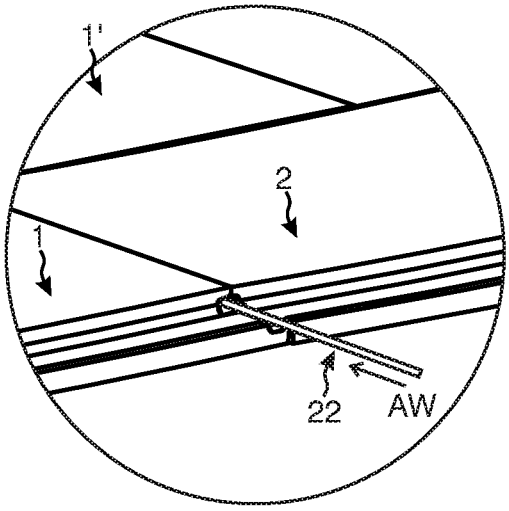

In some embodiments, and as shown in FIGS. 12*a*-12*c*, the unlocking may be accomplished by means of a raising element 16. The raising element 16 may comprise a wedge portion 16*a* and a, preferably inclined, support portion 16*b*, see FIG. 12*c*. This type of unlocking may be especially suitable when the panels 1, 2 are arranged on a subfloor 20, which preferably is substantially levelled or even. For example, the assembled first 1 and second 2 panels may be raised or angled together along the third edge portions 1*c*, 2*c*, e.g., by inserting the raising element 16 between the rear side 2*f* of the second panel 2 and the subfloor 20. For example, the raising element 16 may be gradually displaced under the rear side 2*f* and the assembled panels 1, 2 may be gradually raised vertically by means of the wedge portion 16*a*. When inserted, the rear side 2*f* may thereby rest on the support portion 16*b*. Thereafter, a force F may be applied to the front side 1*e* of the first panel 1, whereby the first 1*a* and second 2*b* edge portions may be relatively displaced vertically A2 away from each other and hence may become vertically unlocked, cf. FIG. 12*b*. By applying a larger force F, the unlocking may become more rapid.

In some embodiments, and as shown in 13*a*-13*d*, a separate tool 22, such as an elongated rod, may be used for unlocking the edge portions 1*a*, 2*b*, and hence disassembling the panels 1, 2. Such an unlocking is preferred for the embodiment in FIGS. 10*c*-10*e*, as indicated by the dashed line in FIG. 10*e* (see arrow A2 or A2'). Preferably, the separate tool 22 comprises a cylindrical end portion 23, for example having a cylindrical cross-section along its entire length direction, but other geometries are also possible. In non-limiting embodiments, a thickness TT of the separate tool may be 0.5-2.0 mm, preferably 0.8-1.5 mm, such as 1.1 mm. The separate tool 22 may be inserted into the tongue groove 5 (see arrow AW) such that the separate tongue 3, such as the locking portion 6, may be gradually displaced out from the tongue groove 5 along the second edge portion 2*b* and inserted into the insertion groove 4 along the first edge portion 1*a*. Thereby, the edge portions 1*a*, 2*b* may be gradually unlocked from each other.

Other ways of unlocking are equally conceivable, especially those described on page 18, line 22 to page 21, line 10 and FIGS. 13, 14*a*-14*d*, 15*a*-15*b* and 16*a*-16*b* in WO 2022/197234 A1, whose contents hereby are explicitly incorporated by reference.

Figure 4A:
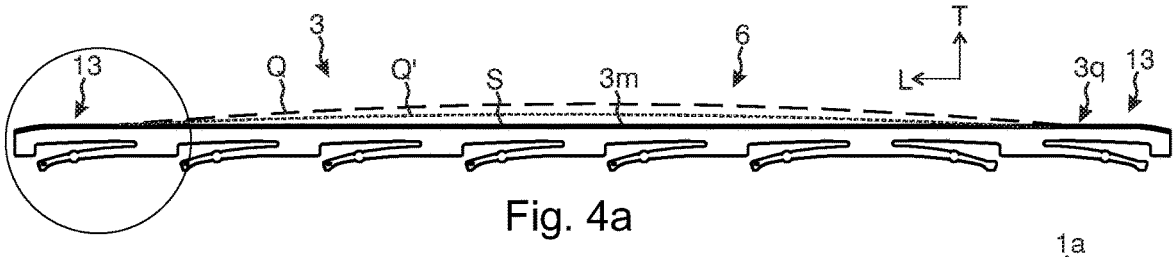
FIG. 4*c* illustrates in a cutaway perspective view an embodiment of a first panel and a separate tongue in a locked state of the edge portions.
FIGS. 4*d*-4*e* illustrate in a perspective view (FIG. 4*d*) and a corresponding enlarged perspective view (FIG. 4*e*) an embodiment of a separate tongue.
Figure 4B:
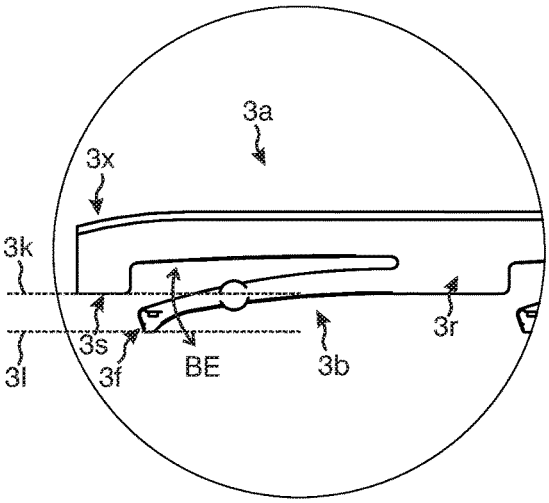
Figure 4C:
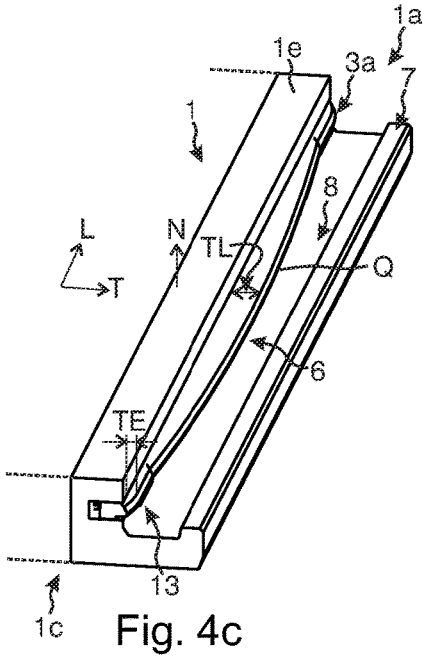
Figure 4D:
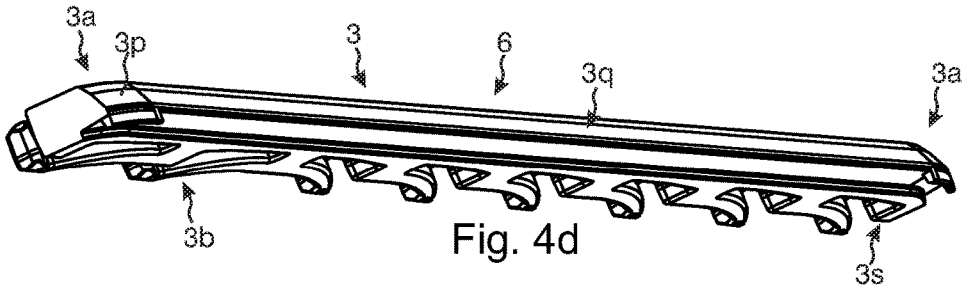
Figure 4E:
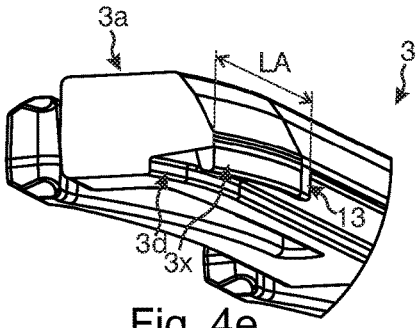

During locking and/or unlocking, the separate tongue 3 may be at least partially, such as essentially entirely, straightened along its longitudinal extension, cf. FIG. 4*a*. For example, when it is displaced into the insertion groove 4, the outermost surface 3*m* of the separate tongue, preferably at least at the locking portion 6, may be straightened. Preferably, it is straightened from a convex shape (cf. curve Q) to a less convex shape (cf. curve Q'), such as being essentially straight, e.g., any local portion of the outermost surface 3*m* forming a maximal angle of 0°-10°, preferably 0°-5°, more preferably 0°-2°, with respect to the inner portion 4*a*, or completely straight (i.e. 0°) (see curve S). For example, the outermost surface 3*m* may be specified in a top view of the separate tongue 3 and/or first panel 1.

When at least one separate tongue 3 is provided along the short edge portion 1*a*, 2*a*, such as in FIG. 1*a*, the short edge portions may be locked or unlocked by folding and the long edge portions comprising an integrally formed locking device may be locked or unlocked by angling. When at least one separate tongue 3 is provided along the short edge portion 1*a*, 2*a* and at least one separate tongue 3 is provided along long 1*c*, 2*c* edge portion, such as in FIG. 1*b*, the short or long edge portions may be locked or unlocked by angling and/or folding.

The disclosure has mainly been described above with reference to a few embodiments. However, as is readily appreciated by a person skilled in the art, other embodiments than the ones disclosed above are equally possible within the scope of the disclosure. For instance, it is clear that any of the embodiments in FIGS. 2*a*-2*f*, 4*c*, 5*d*-5*e*, 7*a*-7*f*, 8*a*-8*f*, 9*a*-9*f*, 10*a*-10*e* and 11*a* may be embodied as in FIG. 1*c* or 1*d* in the locked state, with proper modifications depending on whether the separate tongue 3 comprises a single abutment member 13 or two of them at two opposing longitudinal end portions 3*a*. Furthermore, it is emphasized that any of the panels 1, 2, 1' herein may comprise any of the core materials and/or any of the layers, or combinations thereof, as specified at the end of the summary herein, whereby reference is made thereto. Finally, it is clear that any folding displacement described herein, such as of the edge portions 1*a*, 2*b*, may be accomplished by angling of an adjacent edge portion, such as of a third edge portion 2*c*, cf. FIGS. 1*e* and 12*a*-12*c*.

The invention claimed is:

1. A set of panels comprising a first panel and a second panel and a locking device for locking a first edge portion of the first panel to a second edge portion of the second panel, wherein the first and second panels comprise a front side and a rear side, a normal of a main plane extending along the front and/or the rear side defining a vertical direction extending away from the front sides of the first and second panels, wherein the locking device comprises a horizontal locking device and a vertical locking device, the vertical locking device comprising:

a separate tongue arranged in an insertion groove of said first edge portion, a longitudinal extension of the separate tongue extending along the first edge portion, and a tongue groove provided in, and extending along, said second edge portion, wherein in a vertically locked state of the first and second edge portions:

an abutment member provided at a longitudinal end portion of the separate tongue cooperates with a stop surface of the second edge portion, the stop surface being planar and extending essentially vertically, and a locking portion of the separate tongue cooperates with the tongue groove, wherein, during locking, the locking portion is configured to be gradually inserted into the insertion groove along the first edge portion in a first stage, and in a second subsequent stage the locking portion is configured to be gradually inserted into the tongue groove along the second edge portion.

2. The set of panels according to claim 1, wherein the abutment member is provided in an outer and lower portion of the separate tongue.

3. The set of panels according to claim 1, wherein the abutment member projects downwards.

4. The set of panels according to claim 1, wherein the abutment member is one of at least two abutment members, and wherein opposing longitudinal end portions of the separate tongue both comprise a respective one of the at least two abutment members.

5. The set of panels according to claim 1, wherein the first edge portion of the first panel and the second edge portion of the second panel are short edge portions, the short edge portions being shorter than long edge portions.

6. The set of panels according to claim 1, wherein the stop surface is disposed below the tongue groove.

7. The set of panels according to claim 1, wherein the stop surface is disposed outside an opening of the tongue groove.

8. The set of panels according to claim 1, wherein the locking portion of the separate tongue is spaced from the stop surface in the vertically locked state.

9. The set of panels according to claim 1, wherein the abutment member is pretensioned against the stop surface in said vertically locked state.

10. The set of panels according to claim 1, wherein the separate tongue comprises flexible members configured to face an inner portion of the insertion groove when the separate tongue is arranged in the insertion groove, the flexible members being configured to displace the separate tongue outwards during locking or unlocking.

11. The set of panels according to claim 10, wherein the flexible members each extend from a respective base portion of the separate tongue, a flexible member extending from a base portion arranged at the longitudinal end portion extending from and being bendable around a longitudinal inner side of the base portion.

12. The set of panels according to claim 10, wherein the abutment member is at least partially arranged longitudinally outwards from the flexible members.

13. The set of panels according to claim 1, wherein the locking portion of the separate tongue is longitudinally bent in the vertically locked state.

14. The set of panels according to claim 1, wherein the horizontal locking device comprises a locking element arranged on a strip extending horizontally outwards from a lower portion of the first edge portion and a locking groove provided in the second edge portion, the locking element and the locking groove being configured to cooperate to provide a horizontally locked state of the first and the second edge portions.

15. The set of panels according to claim 1, wherein the first and second edge portions are configured to be vertically unlocked by a forced relative vertical displacement of the first and second edge portions away from each other and/or by a repeated forced relative vertical displacement of the first and second edge portions away and towards each other.

16. The set of panels according to claim 1, wherein, during locking, the second edge portion cooperates with the locking portion for displacing the separate tongue into the insertion groove.

17. The set of panels according to claim 1, wherein the abutment member and the locking portion of the separate tongue are operatively coupled such that, during locking, the second edge portion pushing the locking portion in a direction toward an inner portion of the insertion groove causes the abutment member to move together with the locking portion in the direction toward the inner portion of the insertion groove.

18. The set of panels according to claim 1, wherein the abutment member comprises a straight portion extending in parallel with a longitudinal extension of the separate tongue.

19. The set of panels according to claim 18, wherein said straight portion is arranged longitudinally inside of a longitudinally curved section provided in the longitudinal end portion.

20. The set of panels according to claim 1, wherein the abutment member is disposed below the tongue groove in the vertically locked state, and contacts the stop surface below the tongue groove in the vertically locked state.

* * * * *